US010895043B2

(12) United States Patent
Asanoma et al.

(10) Patent No.: US 10,895,043 B2
(45) Date of Patent: Jan. 19, 2021

(54) TRACK, TRAVEL PATH FORMING UNIT, TRACK LAYING METHOD, AND TRACK MAINTENANCE METHOD

(71) Applicant: Mitsubishi Heavy Industries Engineering, Ltd., Kanagawa (JP)

(72) Inventors: Toshiaki Asanoma, Tokyo (JP); Yukihide Yanobu, Tokyo (JP); Hiroyuki Kono, Tokyo (JP); Koji Uchida, Tokyo (JP); Akihisa Kawauchi, Tokyo (JP); Yoshinobu Murakami, Tokyo (JP); Yasuyuki Mukai, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 366 days.

(21) Appl. No.: 15/766,237

(22) PCT Filed: Oct. 7, 2016

(86) PCT No.: PCT/JP2016/079932
§ 371 (c)(1),
(2) Date: Apr. 5, 2018

(87) PCT Pub. No.: WO2017/061596
PCT Pub. Date: Apr. 13, 2017

(65) Prior Publication Data

US 2018/0298562 A1 Oct. 18, 2018

(30) Foreign Application Priority Data

Oct. 8, 2015 (JP) ..... 2015-200196

(51) Int. Cl.
*E01B 25/28* (2006.01)
*E01B 9/04* (2006.01)
(Continued)

(52) U.S. Cl.
CPC ..... *E01B 25/28* (2013.01); *E01B 9/04* (2013.01); *E01B 25/04* (2013.01); *E01C 9/02* (2013.01)

(58) Field of Classification Search
CPC . E01B 9/04; E01B 25/04; E01B 25/28; E01C 5/005; E01C 9/02
(Continued)

(56) References Cited

U.S. PATENT DOCUMENTS 1,367,236 A * 2/1921 Bullock ..... E01B 25/28 238/5
2,228,029 A * 1/1941 Cambridge ..... B61F 9/00 104/245
(Continued)

FOREIGN PATENT DOCUMENTS

JP 52-85204 U 6/1977
JP 54-155202 U 10/1979
(Continued)

OTHER PUBLICATIONS

International Search Report in PCT/JP2016/079932, dated Nov. 15, 2016. 4pp.
Written Opinion in PCT/JP2016/079932, dated Nov. 15, 2016. 23pp.

*Primary Examiner* — Zachary L Kuhfuss
(74) *Attorney, Agent, or Firm* — Kanesaka Berner and Partners LLP

(57) ABSTRACT

A track includes a travel path including a travel face with which travel wheels of a vehicle come into contact while rolling. The travel path includes a plurality of travel path forming units that are arranged to be adjacent to each other in a travel direction of the vehicle and of which each includes a unit travel face forming part of the travel face and
(Continued)

a positioning unit that fixes a relative position between travel path forming units adjacent to each other.

18 Claims, 16 Drawing Sheets

(51) Int. Cl.
*E01B 25/04* (2006.01)
*E01C 9/02* (2006.01)

(58) Field of Classification Search
USPC ..... 104/245, 247
See application file for complete search history.

(56) References Cited

U.S. PATENT DOCUMENTS 8,430,333 B2 * 4/2013 Andre ..... E01B 25/28 105/72.2
8,511,931 B2 8/2013 Klotz et al.
2007/0079724 A1 * 4/2007 Lohr ..... E01B 25/28 105/72.2
2015/0144021 A1 5/2015 Buse
2015/0152638 A1 * 6/2015 Hammond ..... E01B 3/40 52/220.1
2018/0298562 A1 * 10/2018 Asanoma ..... E01B 25/04

FOREIGN PATENT DOCUMENTS

JP 1-121401 A 5/1989
JP 2-272101 A 11/1990
JP 2002-69906 A 3/2002
JP 2013-506775 A 2/2013
JP 2013-112927 A 6/2013
JP 2014-530973 A 11/2014
JP 2014-234693 A 12/2014
TW I260360 B 8/2006

* cited by examiner

TRACK, TRAVEL PATH FORMING UNIT, TRACK LAYING METHOD, AND TRACK MAINTENANCE METHOD

RELATED APPLICATIONS

The present application is a National Phase of International Application No. PCT/JP2016/079932, filed on Oct. 7, 2016.

TECHNICAL FIELD

The invention relates to a track, a travel path forming unit, a track laying method, and a track maintenance method.

Priority is claimed on Japanese Patent Application No. 2015-200196, filed Oct. 8, 2015, the content of which is incorporated herein by reference.

BACKGROUND ART

As a new transportation system which is a new transportation means other than buses and railways, a track transportation system in which a vehicle travels on a track using travel wheels including a rubber tire or the like is known. Such a track transportation system is generally referred to as a new transportation system or an automated people mover (APM).

A track on which such a type of vehicle travels includes a travel path on which the travel wheels formed of rubber roll and guide rails serving as a guide track disposed along the travel path. The vehicle includes guide wheels in addition to the travel wheels. By the guide wheels coming into contact with the guide rails, a travel direction of the vehicle is regulated.

When a track of a track transportation system is disposed on soft ground, there is a likelihood that track irregularity such as distortion of a travel path will occur due to variation in road bed conditions such as ground subsidence. Accordingly, in order to cause a vehicle to travel stably, it is necessary to curb occurrence of track irregularity. Therefore, when a track of a track transportation system is laid, the track may be laid, for example, after treatment such as ground modification or road bed reinforcement has been carried out in order to curb variation in road bed conditions.

On the other hand, in a railroad in which a train travels on iron rails using iron wheels, a track including rails is laid by employing a ballast track for soft ground. In a ballast track, positions of the rails can be adjusted by adding ballast between the rails and the ground bed even when ground subsidence occurs. That is, in a ballast track, it is possible to adjust the positions of the rails to repair track irregularity by partial maintenance such as addition of ballast. Accordingly, in a ballast track, it is possible to decrease initial costs for laying the track in comparison with a case in which the ground itself is reinforced.

In railroads, a slab track in which a base for installing iron rails is formed by lining up a plurality of plate-shaped members formed of concrete may be used instead of a ballast track. For example, in a slab track described in Patent Literature 1, a slab track is installed on ballast by filling a space between neighboring track-slab panels with concrete. In such a slab track, fluidic grout materials such as cement pastes, cement admixtures, or resin materials are injected into the ballast. Accordingly, in the slab track described in Patent Literature 1, the ballast itself is reinforced by filling voids in the ballast.

CITATION LIST

Patent Literature

[Patent Literature 1]
Japanese Unexamined Patent Application, First Publication No. H02-272101

SUMMARY OF INVENTION

Technical Problem

However, in the above-mentioned slab track, the ballast itself is reinforced. Accordingly, when ground subsidence occurs, a gap may be formed between the ballast and a track-slab panel and there is a likelihood that the track-slab panel formed of concrete will splinter. In the slab track, the track-slab panels are fixed to each other by filling a space between neighboring track-slab panels with concrete. Accordingly, in the slab track, it is difficult to adjust the positions of the rails by performing partial maintenance.

In a track of a track transportation system, travel wheels come in direct contact with a travel path without rails being interposed therebetween unlike a vehicle using iron wheels. Accordingly, when ground subsidence occurs and a road surface is partially distorted, there is a likelihood that an influence on travel will be greater than that in a railroad using rails. Accordingly, there is demand for formation of a travel path on which travel wheels can travel and in which maintenance thereof is easy.

The invention provides a track, a travel path forming unit, a track laying method, and a track maintenance method that can enable formation of a travel path on which travel wheels can travel directly and which can be maintained easily.

Solution to Problem

In order to achieve the above-mentioned object, the invention provides the following means.

According to a first aspect of the invention, there is provided a track including a travel path including a travel face with which travel wheels of a vehicle come into contact while rolling, wherein the travel path includes: a plurality of travel path forming units that are arranged to be adjacent to each other in a travel direction of the vehicle and of which each includes a unit travel face forming part of the travel face; and a positioning unit that fixes a relative position between the travel path forming units adjacent to each other.

According to this configuration, since the relative positions between the plurality of travel path forming units are fixed by the positioning units, it is possible to form the travel face using a plurality of unit travel faces. Accordingly, even when ground subsidence occurs in part of a road bed, it is possible to partially adjust the position of the travel face relative to the road bed by replacing only the travel path forming unit corresponding to the position at which ground subsidence has occurred or adjusting the position. That is, it is possible to simply perform maintenance of the travel path at low costs in a short time.

According to a second aspect of the invention, in the track according to the first aspect, each travel path forming unit may include an inclined face that is formed to be inclined with respect to the travel direction at an end face opposite to an end face of another adjacent travel path forming unit.

According to this configuration, a boundary between neighboring travel path forming units can be inclined with respect to the travel direction. That is, joints between the travel path forming units can be inclined with respect to a direction in which the travel wheels enter the unit travel faces. Accordingly, it is possible to curb noise or rattling when the vehicle travels on the joints between neighboring travel path forming units.

According to a third aspect of the invention, in the track according to the second aspect, each travel path forming unit may include, as the inclined face, a first inclined face that faces one side in the travel direction and a second inclined face that is inclined in a direction other than that of the first inclined face with respect to the travel direction and faces the other side in the travel direction.

According to this configuration, since the angles of the first inclined face and the second inclined face are different from each other, it is possible to make conditions irregular when the travel wheels pass through the joints between the travel path forming units in cases in which the travel wheels enter or leave the travel path forming units. Accordingly, it is possible to further curb noise or rattling when the vehicle travels on the joints between neighboring travel path forming units.

According to a fourth aspect of the invention, in the track according to the third aspect, the travel path may include a first travel path forming unit and a second travel path forming unit which are alternately arranged in the travel direction as the travel path forming units, and the first inclined face of the first travel path forming unit and the first inclined face of the second travel path forming unit may be inclined in different directions with respect to the travel direction.

According to this configuration, simply by arranging the first travel path forming unit and the second travel path forming unit having the inclined faces of different angles on one side and the other side in the travel direction, it is possible to curb an increase in a gap between neighboring travel path forming units and to form a curved travel path such as a curved section.

According to a fifth aspect of the invention, in the track according to the fourth aspect, a length in the travel direction of the second travel path forming unit may be larger than a length in the travel direction of the first travel path forming unit.

According to this configuration, the number of travel path forming units used in a straight section can be decreased when forming the travel path. Accordingly, it is possible to reduce manufacturing costs at the time of laying a track.

According to a sixth aspect of the invention, in the track according to any one of the first to fifth aspects, each travel path forming unit may include: a first plate with which only a travel wheel on one side in a width direction of the vehicle comes in contact; and a second plate that is disposed separated from the first plate in the width direction and with which only the travel wheel on the other side in the width direction comes in contact.

According to this configuration, each travel path forming unit includes two members such as the first plate and the second plate which are separated from each other in the width direction. Accordingly, the travel face on one side in the width direction and the travel face on the other side in the width direction can be formed of different members. Accordingly, it is not necessary to integrally form an area between the travel faces which are separated in the width direction from each other and it is possible to decrease manufacturing costs of the travel path forming units.

According to a seventh aspect of the invention, in the track according to any one of the first to sixth aspects, the travel path may include guide posts to which a guide rail that guides the vehicle is attached, and each guide post may be fixed to the corresponding travel path forming unit and extend in a direction crossing the unit travel face.

According to this configuration, a plurality of travel path forming units can be fixed to the guide rails using the guide posts. Accordingly, simply by adjusting the positions of the guide rails relative to the road bed, it is possible to adjust the positions of the plurality of unit travel faces forming the travel face relative to the road bed. That is, it is possible to adjust the positions of a plurality of unit travel faces together without individually adjusting the positions of the plurality of travel path forming units including the unit travel face relative to the road bed. Accordingly, it is possible to form a travel face extending smoothly in the travel direction with respect to the road bed.

According to an eighth aspect of the invention, in the track according to the seventh aspect, the travel path may include support members of which each protrudes outward in the width direction from an end face of the corresponding travel path forming unit crossing the corresponding unit travel face and facing the width direction of the vehicle and to which the corresponding guide posts are fixed.

According to this configuration, it is not necessary to increase the size of each travel path forming unit in the width direction of the vehicle in order to install the guide posts. Accordingly, it is possible to reduce manufacturing costs of the travel path forming units.

According to a ninth aspect of the invention, in the track according to any one of the first to eighth aspects, the travel path forming units may be arranged directly on ballast installed on a road bed.

According to this configuration, by disposing the ballast between the road bed and the travel path, it is possible to adjust the travel path itself and to adjust the position of the travel face by adding the ballast even when the road bed is offset due to ground subsidence or the like. Accordingly, it is possible to further reduce maintenance costs for repairing distortion of the travel face or the like.

According to a tenth aspect of the invention, the track according to any one of the first to eighth aspects may further include: a crosstie that is embedded in ballast; and a plurality of rails that are installed on the crosstie and are arranged separated in the width direction of the vehicle from each other, and the travel path forming units may be arranged such that the unit travel faces are provided on the rails.

According to this configuration, the travel face can be formed using the rails. That is, the travel face can be formed on the rails of which the slopes with respect to the road bed have been adjusted. Accordingly, it is possible to adjust the positions of the plurality of unit travel faces together without individually adjusting the positions of the plurality of travel path forming units including the unit travel face with respect to the road bed. Accordingly, it is possible to form a travel face extending smoothly in the travel direction with respect to the road bed.

According to an eleventh aspect of the invention, there is provided a travel path forming unit that forms a travel path including a travel face with which travel wheels of a vehicle come in contact while rolling by arranging a plurality of travel path forming units to be adjacent to each other in a travel direction of the vehicle, the travel path forming unit including a unit travel face that forms part of the travel face and an end face that crosses the unit travel face and faces another travel path forming unit adjacent thereto, the end face including an inclined face that is inclined with respect to the travel direction.

According to a twelfth aspect of the invention, the travel path forming unit according to the eleventh aspect may further include a positioning unit that fixes a position relative to another adjacent travel path forming unit.

According to a thirteenth aspect of the invention, the travel path forming unit according to the eleventh or twelfth aspect may further include an end face that crosses the unit travel face and opposes an end face of the other adjacent travel path forming unit, and the end face may include an inclined face that is formed to be inclined with respect to the travel direction.

According to a fourteenth aspect of the invention, the travel path forming unit according to the thirteenth aspect may further include, as the inclined face, a first inclined face that faces one side in the travel direction and a second inclined face that is inclined in a direction other than that of the first inclined face with respect to the travel direction and faces the other side in the travel direction.

According to a fifteenth aspect of the invention, the travel path forming unit according to any one of the eleventh to fourteenth aspects may further include: a first plate with which only the travel wheel on one side in a width direction of the vehicle comes in contact; and a second plate that is disposed separated from the first plate in the width direction and with which only the travel wheel on the other side in the width direction comes in contact.

According to a sixteenth aspect of the invention, the travel path forming unit according to any one of the eleventh to fifteenth aspects may further include a guide post to which a guide rail that guides the vehicle is attached and that extends in a direction crossing the unit travel face.

According to a seventeenth aspect of the invention, the travel path forming unit according to the sixteenth aspect may further include a support member that protrudes outward in the width direction from an end face crossing the unit travel face and facing the width direction of the vehicle and to which the guide post is fixed.

According to an eighteenth aspect of the invention, there is provided a method of laying a track including a travel path that includes a travel face with which travel wheels of a vehicle come in contact while rolling, the method including: an arrangement step of arranging a plurality of travel path forming units, each of which includes a unit travel face forming part of the travel face, in a travel direction of the vehicle; a position adjusting step of connecting the travel path forming units adjacent to each other using a positioning unit that fixes a relative position between the travel path forming units adjacent to each other and adjusting slopes of the plurality of unit travel faces with respect to a road bed together; and a travel path forming unit fixing step of fixing positions of the travel path forming units relative to the road bed.

According to a nineteenth aspect of the invention, in the method of laying a track according to the eighteenth aspect, the arrangement step may include arranging each travel path forming unit including an inclined face that is formed to be inclined with respect to the travel direction at an end face opposes an end face of the other adjacent travel path forming unit.

According to a twentieth aspect of the invention, in the track laying method according to the eighteenth or nineteenth aspect, the arrangement step may include: a first arrangement step of arranging a plurality of first travel path forming units, each of which includes a first inclined face that faces one side in the travel direction and a second inclined face that is inclined in a direction other than that of the first inclined face with respect to the travel direction and faces the other side in the travel direction, at intervals in the travel direction; and a second arrangement step of arranging a plurality of second travel path forming units, each of which includes a first inclined face that is inclined in a direction other than that of the first inclined face of the first travel path forming unit with respect to the travel direction and that faces one side in the travel direction, between two of the first travel path forming units adjacent to each other in the travel direction.

According to a twenty-first aspect of the invention, in the track laying method according to any one of the eighteenth to twentieth aspects, the arrangement step may include arranging the travel path forming units of which each includes a guide post to which a guide rail guiding the vehicle is attached and that extends in a direction crossing the unit travel face, and the position adjusting step may include a guide rail fixing step of fixing the guide rail to the plurality of guide posts.

According to a twenty-second aspect of the invention, in the track laying method according to any one of the eighteenth to twenty-first aspects, the position adjusting step may include a travel path forming unit lifting step of lifting the travel path forming units from the road bed, and the travel path forming unit fixing step may include loading ballast between the lifted travel path forming units and the road bed and fixing positions of the travel path forming units relative to the road bed.

According to a twenty-third aspect of the invention, in the track laying method according to any one of the eighteenth to twenty-second aspects, the arrangement step may include arranging the travel path forming units on a plurality of rails that are installed on a crosstie embedded in ballast and that are arranged to be separated from each other in the width direction of the vehicle.

According to a twenty-fourth aspect of the invention, there is provided a method of maintaining a track including a travel path including a travel face with which travel wheels of a vehicle come into contact while rolling, the travel path including a plurality of travel path forming units that are arranged to be adjacent to each other in a travel direction of the vehicle and of which each includes a unit travel face forming part of the travel face, and a positioning unit that fixes a relative position between the travel path forming units adjacent to each other, wherein only a travel path forming unit corresponding to a travel face of which a position is partially offset is replaced.

Advantageous Effects of Invention

According to the invention, it is possible to form a travel path on which travel wheels can travel directly and which can be maintained easily by lining up a plurality of travel path forming units.

DESCRIPTION OF EMBODIMENTS

First Embodiment

Figure 1:
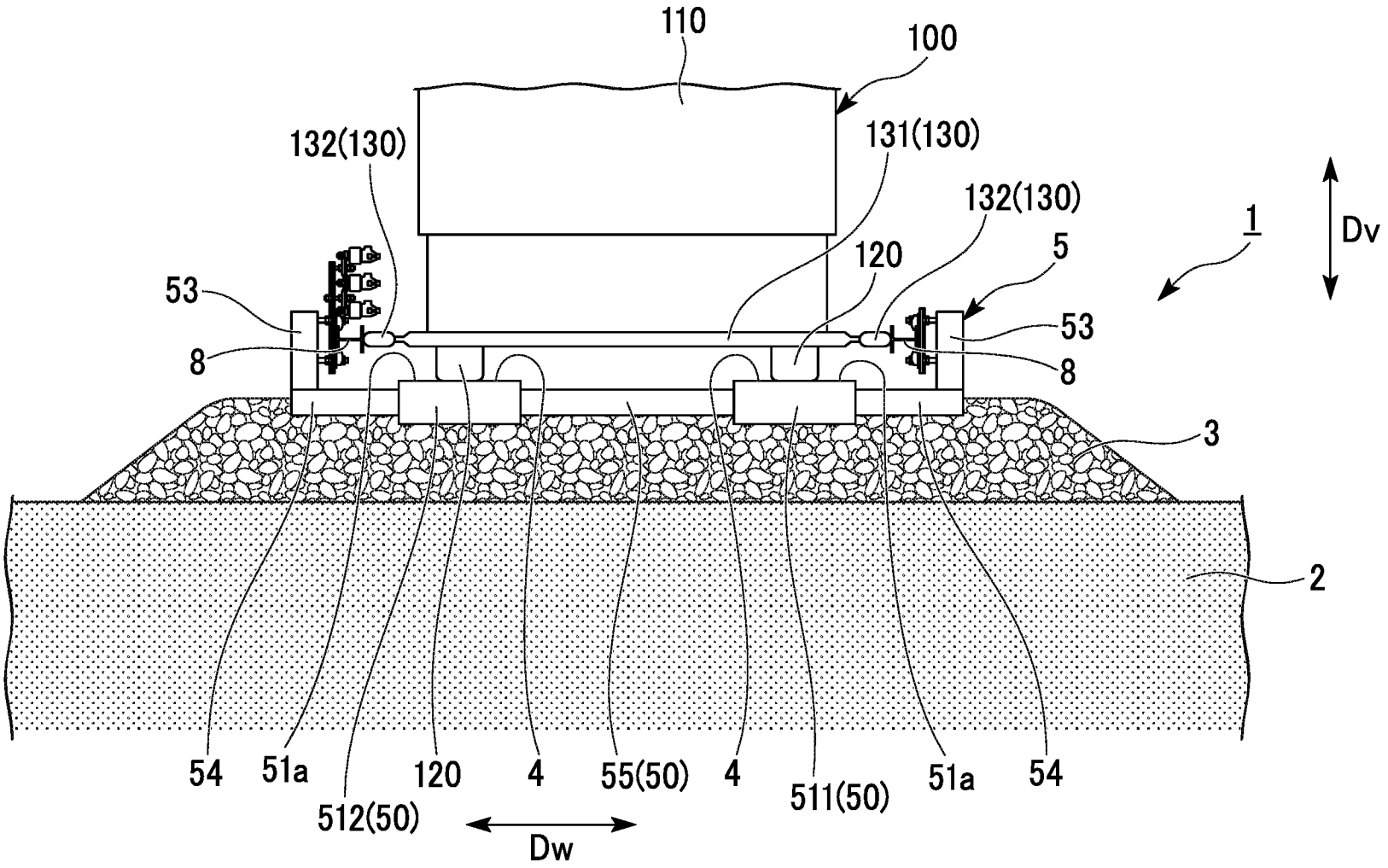
FIG. 1 is a sectional view illustrating a track and a vehicle according to a first embodiment.

Hereinafter, a track according to a first embodiment of the invention will be described with reference to FIGS. 1 to 4.

A track 1 according to the first embodiment of the invention is a track on which a guide rail type railroad vehicle travels while steering travel wheels 120 with a reaction force applied from guide rails 8 that guide the vehicle 100.

In the following description, a direction in which the vehicle 100 travels is referred to as a travel direction Dr. A width direction of the vehicle 100 which is perpendicular to the travel direction Dr is simply referred to as a width direction Dw. A direction which is perpendicular to the travel direction Dr and the width direction Dw is referred to as a vertical direction Dv. In this embodiment, the vertical direction Dv is a direction which is perpendicular to a travel face 4 which will be described later unlike a vertical direction in the precise meaning. In this embodiment, one (a first) side in the width direction Dw with respect to the center in the width direction Dw of the vehicle 100 is defined as a right side (the right side in FIG. 1), and the other (a second) side in the width direction Dw is defined as a left side (the left side in FIG. 1). In this embodiment, one (a first) side in the travel direction Dr with respect to the vehicle 100 is defined as a front side (the lower side in FIG. 2), and the other (a second) side in the travel direction Dr with respect to the vehicle 100 is defined as a rear side (the upper side in FIG. 2).

The vehicle 100 (a guide rail type railroad vehicle) traveling on the track 1 according to this embodiment is a vehicle in a side guide rail type new transportation system as illustrated in FIG. 1. The vehicle 100 includes a vehicle body 110, travel wheels 120, and a guide device 130.

The vehicle body 110 includes a box-shaped structure in outer shape having a cavity therein. A door, a window, or the like which is not illustrated is provided in a side portion of the vehicle body 110.

The travel wheels 120 are disposed on the bottom of the vehicle body 110. The travel wheels 120 are provided on the lower side of the vehicle body 110 in the vertical direction Dv. The travel wheels 120 are provided on the right side and the left side of the vehicle body 110 in the width direction Dw. The travel wheels 120 are rotationally driven by a power unit by receiving electric power from a trolley wire via a power collecting device. The travel wheels 120 are not formed of a metal material, unlike iron wheels, but are formed of, for example, a rubber material such as rubber tires.

The guide device 130 guides the vehicle 100 in the target travel direction Dr along guide rails 8 which will be described later. The guide device 130 includes a guide frame 131 which is disposed on the lower side of the vehicle body 110 and guide wheels 132 which are rotatably supported by the guide frame 131.

The guide wheels 132 are disposed outwards of the side surfaces of the vehicle body 110. The guide wheels 132 are supported in the guide frame 131 to be rotatable around a rotation shaft extending in the vertical direction Dv. The guide wheels 132 are provided such that the position thereof in the vertical direction Dv has substantially the same height as that of the guide rails 8. Accordingly, when the vehicle 100 travels, the guide wheels 132 rotate when coming into contact with the guide rails 8.

The track 1 extends along a predetermined route, and straight sections and curved sections are mixed along the way if necessary. The track 1 includes a pair of right and left travel faces 4 with which the travel wheels 120 come in contact while rolling. The travel faces 4 extend in the travel direction Dr. The travel faces 4 in a pair are separated from each other in the width direction Dw to correspond to the positions of the travel wheels 120 in the width direction Dw. In the track 1 according to this embodiment, the travel faces 4 are provided on ballast 3 which is piled on a road bed 2.

The track 1 includes ballast 3, a travel path 5, and guide rails 8.

The ballast 3 includes crushed stones or gravel laid on the road bed 2.

Figure 2:
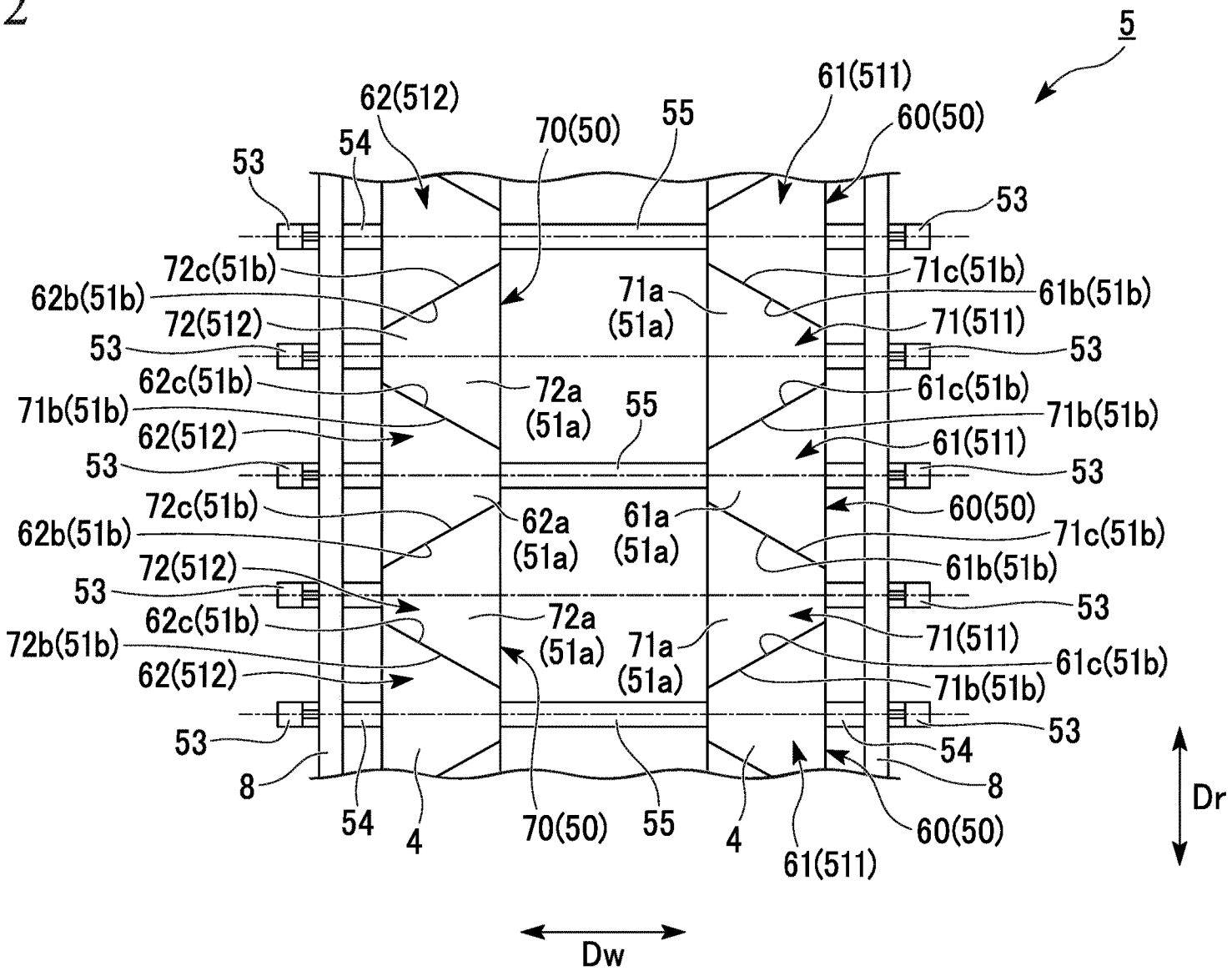
FIG. 2 is a top view illustrating a travel path according to the first embodiment.

The travel path 5 forms the travel face 4 on the road bed 2. The travel path 5 in this embodiment forms the travel face 4 on the road bed 2 with the ballast 3 interposed therebetween. As illustrated in FIG. 2, the travel path 5 includes travel path forming units 50, positioning units 52, guide posts 53, and support members 54.

The guide rails 8 regulate a direction in which the vehicle 100 travels. The guide rails 8 regulate the direction in which the vehicle 100 travels using a reaction force which is generated by contact with the guide wheels 132. The guide rails 8 are provided on both sides of the track 1 in the width direction Dw such that the travel faces 4 are interposed therebetween over the total length of the track 1. The guide rails 8 extend to the same height from the travel faces 4 in the travel direction Dr in which the vehicle 100 travels. The length of the guide rails 8 in the travel direction Dr is set to be larger than that of one travel path forming unit 50. Accordingly, the guide rails 8 are arranged over a plurality of travel path forming units 50.

In this embodiment, a plurality of travel path forming units 50 are arranged to be adjacent to each other in the travel direction Dr of the vehicle 100, and each includes a unit travel face 51*a* forming part of the travel face 4. Part of the travel path forming unit 50 according to this embodiment includes a connection member 55.

The travel path forming units 50 are disposed on the road bed 2 with ballast 3 interposed therebetween. Each travel path forming unit 50 includes a unit travel face 51*a* that can form part of the travel face 4. The unit travel face 51*a* is formed in the travel path forming unit 50 such that the travel path forming unit 50 faces the upper side in the vertical direction Dv when the travel path forming unit 50 is disposed on the ballast 3.

In each travel path forming unit 50, end faces on both sides in the travel direction Dr which cross the unit travel face 51*a* and opposite to an end face of other adjacent travel path forming units 50 include an inclined face 51*b*. The inclined face 51*b* extends to be perpendicular to the unit travel face 51*a* and is inclined with respect to the travel direction Dr. That is, the travel face 4 is formed by arranging a plurality of travel path forming units 50 in parallel in the travel direction Dr and continuously arranging the unit travel faces 51*a* in the travel direction Dr such that the inclined faces 51*b* of the neighboring travel path forming units 50 are opposed to each other. In this embodiment, the travel path forming units 50 are blocks formed of concrete.

As illustrated in FIG. 1, each travel path forming unit 50 includes a first plate 511 with which only the right travel wheel 120 on one side in the width direction Dw comes in contact and a second plate 512 with which only the left travel wheel 120 on the other side in the width direction Dw comes in contact.

In this embodiment, the first plate 511 is formed such that end faces which cross the unit travel face 51*a* and the inclined faces 51*b* and face the width direction Dw are parallel to the travel direction Dr. The first plate 511 is a concrete block having a trapezoidal shape in which the inclined faces 51*b* on both sides in the travel direction Dr come closer to each other to the center of the vehicle 100 in the width direction Dw when viewed in the vertical direction Dv. That is, the unit travel face 51*a* of the first plate 511 in this embodiment has a trapezoidal shape when viewed in the vertical direction Dv.

The second plate 512 is disposed to be separated from the first plate 511 in the width direction Dw. The second plate 512 in this embodiment forms a symmetric shape along with the first plate 511 with respect to the center of the vehicle 100 in the width direction Dw. The second plate 512 is a concrete block having a trapezoidal shape in which the inclined faces 51*b* on both sides in the travel direction Dr come closer to each other from the opposite side of the first plate 511 to the center of the vehicle 100 in the width direction Dw when viewed in the vertical direction Dv. That is, the unit travel face 51*a* of the second plate 512 in this embodiment has a trapezoidal shape when viewed in the vertical direction Dv. The second plate 512 may be formed in the same shape as the first plate 511 based on the symmetry as in this embodiment, or may be formed in a shape or size different from the first plate 511.

The connection member 55 connects the first plate 511 and the second plate 512. The connection member 55 in this embodiment is part of the travel path forming unit 50 and is formed integrally with the first plate 511 and the second plate 512. Specifically, the connection member 55 in this embodiment connects the end faces facing inward of the first plate 511 and the second plate 512 in the width direction Dw. The connection member 55 connects the end face of the first plate 511 crossing the unit travel face 51*a* and facing the left side in the width direction Dw and the end face of the second plate 512 crossing the unit travel face 51*a* and facing the right side in the width direction Dw. The connection member 55 in this embodiment is formed of an H steel material.

A positioning unit 52 fixes a relative position between neighboring travel path forming units 50. The positioning unit 52 in this embodiment detachably connects the travel path forming units 50, that is, one travel path forming unit 50 and another travel path forming unit 50 adjacent to the one travel path forming unit 50. That is, the positioning unit 52 does not completely fix the adjacent travel path forming units 50, but connects them in a detachable state and fixes the external relative position therebetween. The positioning unit 52 in this embodiment is part of the travel path forming unit 50 and is provided in each of the first plate 511 and the second plate 512. Specifically, the positioning unit 52 in this embodiment is formed in the inclined faces 51*b*. The positioning unit 52 includes a convex portion 521 and a concave portion 522.

Figure 3:
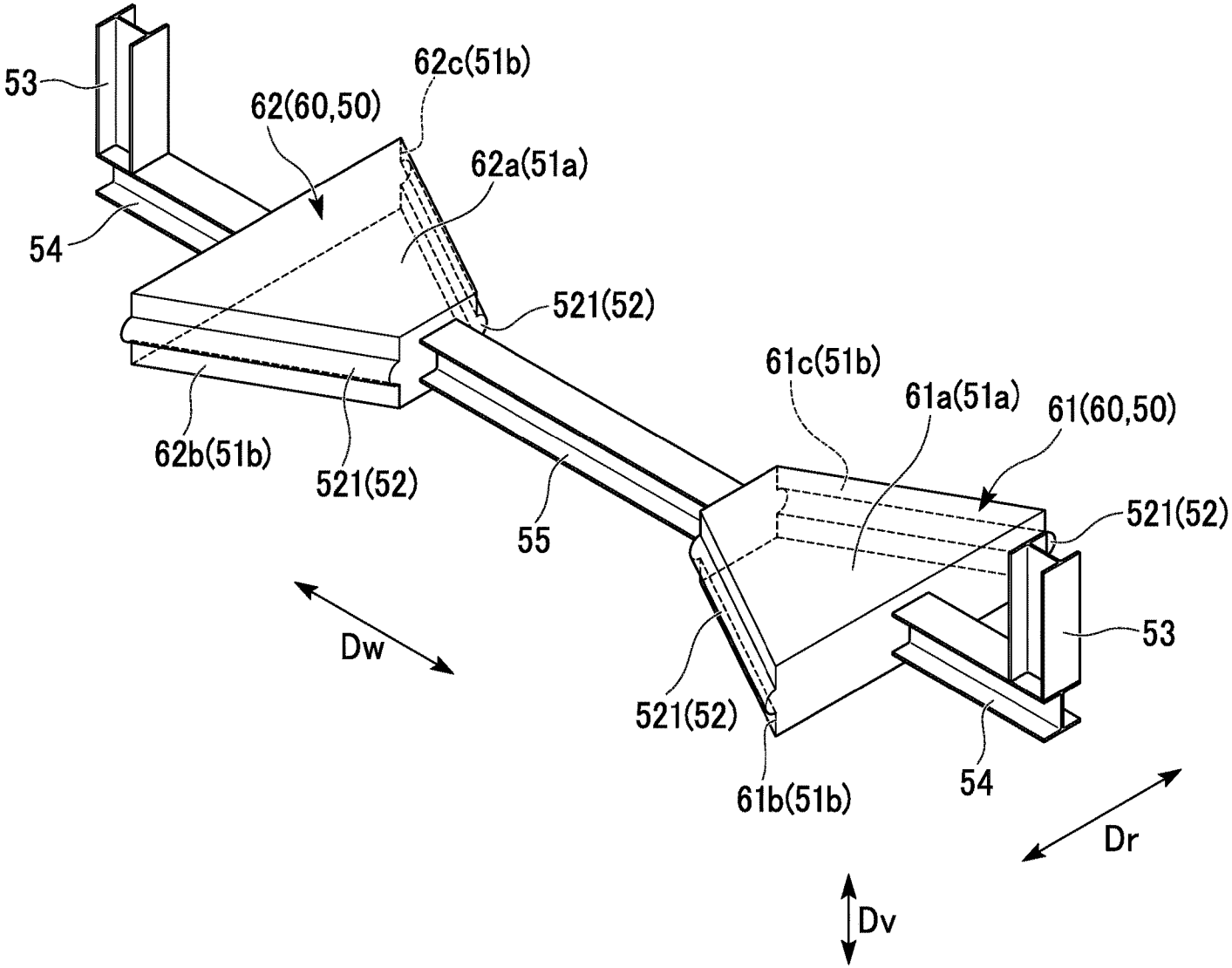
FIG. 3 is a perspective view illustrating a first travel path forming unit according to the first embodiment.

As illustrated in FIG. 3, the convex portion 521 protrudes in the travel direction Dr from the inclined face 51*b*. The convex portion 521 in this embodiment extends in the width direction Dw to form a semicircular sectional shape. The convex portion 521 is formed at the center of the inclined face 51*b* in the vertical direction Dv. That is, the convex portion 521 in this embodiment is formed integrally with the travel path forming unit 50.

Figure 4:
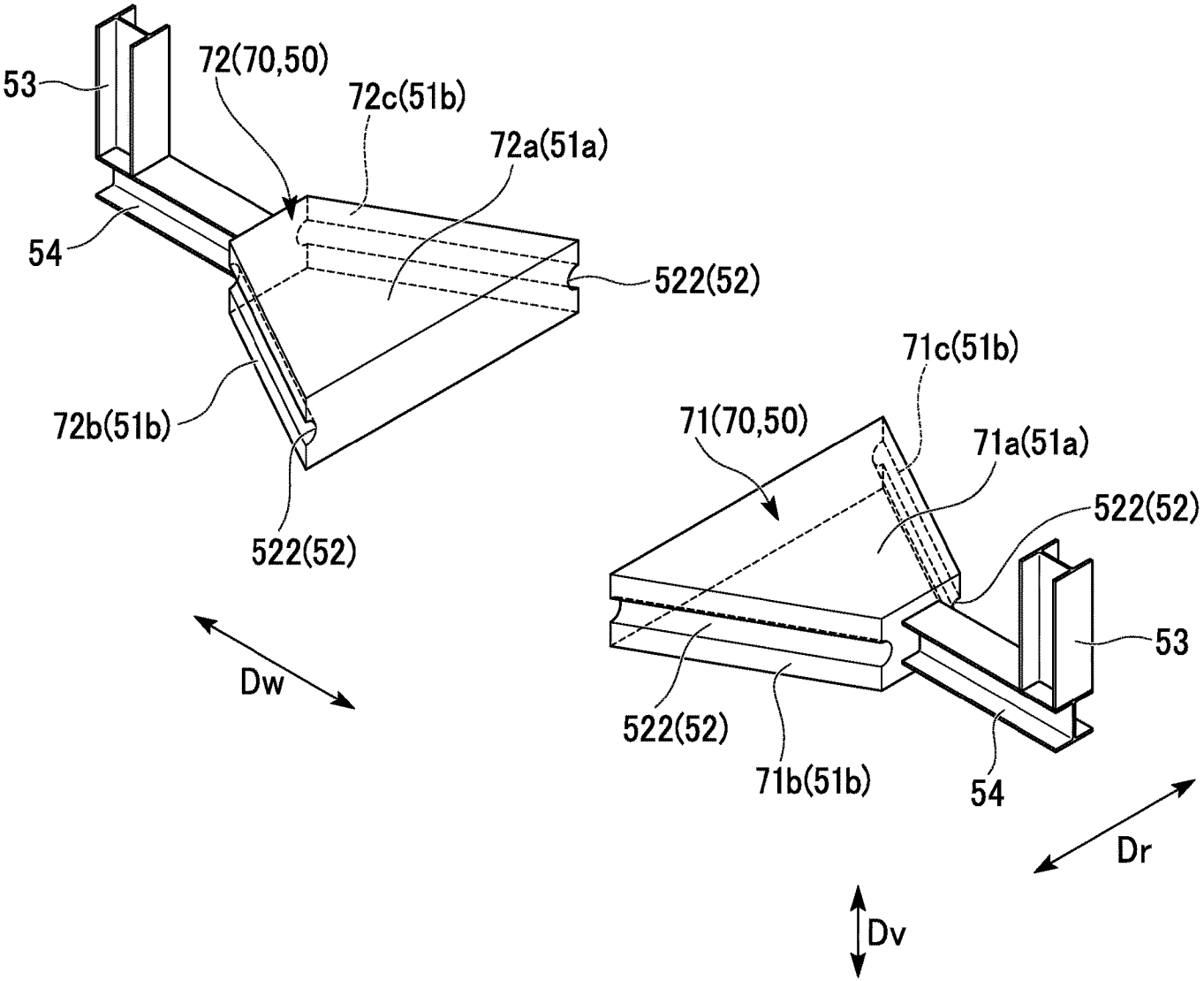
FIG. 4 is a perspective view illustrating a second travel path forming unit according to the first embodiment.

As illustrated in FIG. 4, the concave portion 522 is recessed in the travel direction Dr from the inclined face 51*b*. The concave portion 522 is formed in a size allowing the convex portion 521 to be inserted thereinto to correspond to the shape of the convex portion 521. The concave portion 522 in this embodiment is formed on the inclined face 51*b* of another travel path forming unit 50 which is adjacent in the travel direction Dr to the travel path forming unit 50 in which the convex portion 521 is formed. That is, the concave portion 522 is formed in the travel path forming unit 50 other than the travel path forming unit 50 in which the convex portion 521 is formed. The concave portion 522 extends in the width direction Dw to form a semicircular sectional shape which is slightly larger than the convex portion 521. The concave portion 522 is formed at the center in the vertical direction Dw to have the same position in the vertical direction Dv on the inclined face 51*b* as the convex portion 521.

As illustrated in FIG. 2, the guide posts 53 are formed such that the guide rail 8 can be fixed thereto. The guide posts 53 are fixed to the travel path forming units 50. Each guide post 53 in this embodiment is part of the corresponding travel path forming unit 50 and is formed integrally with the first plate 511 and the second plate 512. Specifically, the guide posts 53 extend in a direction crossing the unit travel face 51*a*. The guide posts 53 in this embodiment extend perpendicularly to the unit travel face 51*a*. The guide posts 53 in this embodiment are formed outside the travel path forming unit 50 in the width direction Dw using a support member 54. The guide rail 8 is fixed to the inside of the guide post 53 in the width direction Dw. That is, the guide post 53 on the right side in the width direction Dw is provided on the right side in the width direction Dw from the first plate 511 and the guide rail 8 is fixed to the left side in the width direction Dw thereof. On the other hand, the guide post 53 on the left side in the width direction Dw is provided on the left side in the width direction Dw from the second plate 512, and the guide rail 8 is fixed to the right side in the width direction Dw thereof. The guide posts 53 in this embodiment are formed of the same H steel material as the connection members 55.

The support members 54 protrude outward in the width direction Dw from the end faces of the travel path forming unit 50 facing the width direction Dw crossing the unit travel face 51*a*. The support members 54 have the guide posts 53 fixed thereto. The support members 54 in this embodiment are part of the travel path forming unit 50 and are formed integrally with the first plate 511 and the second plate 512. Specifically, the support members 54 in this embodiment extend from the end faces of the travel path forming unit 50 facing outward in the width direction. That is, the support member 54 on the right side in the width direction Dw is provided on the right side in the width direction Dw from the first plate 511. In the support member 54 on the right side in the width direction Dw, the guide post 53 is fixed to an end in the width direction Dw which is not connected to the first plate 511. On the other hand, the support member 54 on the left side in the width direction Dw is provided on the left side in the width direction Dw from the second plate 512. In the support member 54 on the left side in the width direction Dw, the guide post 53 is fixed to an end in the width direction Dw which is not connected to the second plate 512. The support members 54 in this embodiment are formed of the same H steel material as the connection members 55 or the guide posts 53.

The travel path 5 in this embodiment includes a first travel path forming unit 60 and a second travel path forming unit 70 which are alternately arranged in the travel direction Dr as the travel path forming unit 50.

As illustrated in FIG. 3, the first travel path forming unit 60 includes a (1A)-th plate 61 as the first plate 511. The first travel path forming unit 60 includes a (2A)-th plate 62 as the second plate 512. The first travel path forming unit 60 includes the connection member 55. The guide post 53 and the support member 54 are connected to the first travel path forming unit 60. In the first travel path forming unit 60 in this embodiment, the support member 54 and the connection member 55 are formed of the same H steel material to form a unified body. That is, in the first travel path forming unit 60, an H steel material is provided to penetrate the (1A)-th plate 61 and the (2A)-th plate 62 in the width direction Dw. Accordingly, in the first travel path forming unit 60, the (1A)-th plate 61 and the (2A)-th plate 62 are connected.

A (1A)-th formation face 61*a* is formed as the unit travel face 51*a* in the (1A)-th plate 61. The (1A)-th formation face 61*a* is a face which has a trapezoidal shape and faces the upper side in the vertical direction Dv. The (1A)-th plate 61 includes a (1*a*1)-th inclined face 61*b* (a first inclined face) that faces the front side in the travel direction Dr and a (1*a*2)-th inclined face 61*c* (a second inclined face) that faces the rear side in the travel direction Dr as the inclined face 51*b*. The (1*a*1)-th inclined face 61*b* and the (1*a*2)-th inclined face 61*c* are inclined in different directions with respect to the travel direction Dr. The (1*a*1)-th inclined face 61*b* is inclined to face the left side which is inward in the width direction Dw and the front side in the travel direction Dr in the (1A)-th plate 61. The (1*a*2)-th inclined face 61*c* is inclined to face the left side in the width direction Dw and the rear side in the travel direction Dr. In the (1A)-th plate 61, the convex portion 521 is formed as the positioning unit 52 in the (1*a*1)-th inclined face 61*b* and the (1*a*2)-th inclined face 61*c*.

A (2A)-th formation face 62*a* is formed as the unit travel face 51*a* in the (2A)-th plate 62. The (2A)-th formation face 62*a* is a face which has a trapezoidal shape with the same size as the (1A)-th formation face 61*a* and faces the upper side in the vertical direction Dv. That is, the (2A)-th plate 62 is formed to have the same length in the travel direction Dr as the (1A)-th plate 61. The (2A)-th plate 62 includes a (2*a*1)-th inclined face 62*b* (a first inclined face) that faces the front side in the travel direction Dr and a (2*a*2)-th inclined face 62*c* (a second inclined face) that faces the rear side in the travel direction Dr as the inclined face 51*b*. The (2*a*1)-th inclined face 62*b* and the (2*a*2)-th inclined face 62*c* are inclined in different directions with respect to the travel direction Dr. The (2*a*1)-th inclined face 62*b* is inclined to face the right side which is inward in the width direction Dw and the front side in the travel direction Dr in the (2A)-th plate 62. The (2*a*1)-th inclined face 62*b* in this embodiment is formed to be parallel to the (1*a*2)-th inclined face 61*c*. The (2*a*2)-th inclined face 62*c* is inclined to face the right side in the width direction Dw and the rear side in the travel direction Dr. The (2*a*2)-th inclined face 62*c* in this embodiment is formed to be parallel to the (1*a*1)-th inclined face 61*b*. In the (2A)-th plate 62, the convex portion 521 is formed as the positioning unit 52 in the (2*a*1)-th inclined face 62*b* and the (2*a*2)-th inclined face 62*c*.

The second travel path forming units 70 are arranged in parallel in the travel direction Dr with respect to the first travel path forming units 60. As illustrated in FIG. 4, each second travel path forming unit 70 includes a (1B)-th plate 71 as the first plate 511. The second travel path forming unit 70 includes a (2B)-th plate 72 as the second plate 512. The guide posts 53 and the support members 54 are connected to the second travel path forming unit 70. The second travel path forming unit 70 in this embodiment does not include the connection member 55 unlike the first travel path forming unit 60. Accordingly, in the second travel path forming unit 70, the (1B)-th plate 71 and the (2B)-th plate 72 are independent from each other.

A (1B)-th formation face 71*a* is formed as the unit travel face 51*a* in the (1B)-th plate 71. The (1B)-th formation face 71*a* in this embodiment is a face which has a trapezoidal shape with the same size as the (1A)-th formation face 61*a* and faces the upper side in the vertical direction Dv. That is, the (1B)-th plate 71 is formed to have the same length in the travel direction Dr as the (1A)-th plate 61. The (1B)-th plate 71 includes a (1*b*1)-th inclined face 71*b* (a first inclined face) that faces the front side in the travel direction Dr and a (1*b*2)-th inclined face 71*c* (a second inclined face) that faces the rear side in the travel direction Dr as the inclined face 51*b*. The (1*b*1)-th inclined face 71*b* and the (1*b*2)-th inclined face 71*c* are inclined in different directions with respect to the travel direction Dr. The (1*b*1)-th inclined face 71*b* is inclined to face the right side which is outward in the width direction Dw and the front side in the travel direction Dr in the (1B)-th plate 71. Accordingly, the (1*a*1)-th inclined face 61*b* and the (1*b*1)-th inclined face 71*b* are inclined in different directions with respect to the travel direction Dr. The (1*b*1)-th inclined face 71*b* is formed to be parallel to the (1*a*2)-th inclined face 61*c*. The (1*b*2)-th inclined face 71*c* is inclined to face the right side in the width direction Dw and the rear side in the travel direction Dr. Accordingly, the (1*a*2)-th inclined face 61*c* and the (1*b*2)-th inclined face 71*c* are inclined in different directions with respect to the travel direction Dr. The (1*b*2)-th inclined face 71*c* is formed to be parallel to the (1*a*1)-th inclined face 61*b*. In the (1B)-th plate 71, the concave portion 522 is formed as the positioning unit 52 in the (1*b*1)-th inclined face 71*b* and the (1*b*2)-th inclined face 71*c*.

A (2B)-th formation face 72*a* is formed as the unit travel face 51*a* in the (2B)-th plate 72. The (2B)-th formation face 72*a* is a face which has a trapezoidal shape with the same size as the (2A)-th formation face 62*a* and faces the upper side in the vertical direction Dv. That is, the (2B)-th plate 72 is formed to have the same length in the travel direction Dr as the (2A)-th plate 62. The (2B)-th plate 72 includes a (2*b*1)-th inclined face 72*b* (a first inclined face) that faces the front side in the travel direction Dr and a (2*b*2)-th inclined face 72*c* (a second inclined face) that faces the rear side in the travel direction Dr as the inclined face 51*b*. The (2*b*1)-th inclined face 72*b* and the (2*b*2)-th inclined face 72*c* are inclined in different directions with respect to the travel direction Dr. The (2*b*1)-th inclined face 72*b* is inclined to face the left side which is outward in the width direction Dw and the front side in the travel direction Dr in the (2B)-th plate 72. Accordingly, the (2*a*1)-th inclined face 62*b* and the (2*b*1)-th inclined face 72*b* are inclined in different directions with respect to the travel direction Dr. The (2*b*1)-th inclined face 72*b* in this embodiment is formed to be parallel to the (2*a*2)-th inclined face 62*c* and the (1*b*2)-th inclined face 71*c*. The (2*b*2)-th inclined face 72*c* is inclined to face the right side in the width direction Dw and the rear side in the travel direction Dr. Accordingly, the (2*a*2)-th inclined face 62*c* and the (2*b*2)-th inclined face 72*c* are inclined in different directions with respect to the travel direction Dr. The (2*b*2)-th inclined face 72*c* in this embodiment is formed to be parallel to the (2*a*1)-th inclined face 62*b* and the (1*b*1)-th inclined face 71*b*. In the (2B)-th plate 72, the concave portion 522 is formed as the positioning unit 52 in the (2*b*1)-th inclined face 72*b* and the (2*b*2)-th inclined face 72*c*.

A track constructing method according to this embodiment will be described below with reference to FIGS. 5 to 11. In the track constructing method according to this embodiment, the track 1 for a guide rail type railroad vehicle that travels while turning the travel wheels 120 with a reaction force from the guide rails 8 that guide the vehicle 100 are laid on the road bed 2 using the travel path 5 and the guide rails 8. In the track constructing method according to this embodiment, an example in which a curved section is formed will be described, but a straight section is also formed using the same steps. The track constructing method according to this embodiment includes an arrangement step S10, a position adjusting step S20, and a travel path forming unit fixing step S30.

In the arrangement step S10, a plurality of travel path forming units 50 are arranged in the travel direction Dr on the road bed 2. The arrangement step S10 in this embodiment includes a first arrangement step S11 of arranging a plurality of first travel path forming units 60 and a second arrangement step S12 of arranging a plurality of second travel path forming units 70.

Figure 5A:
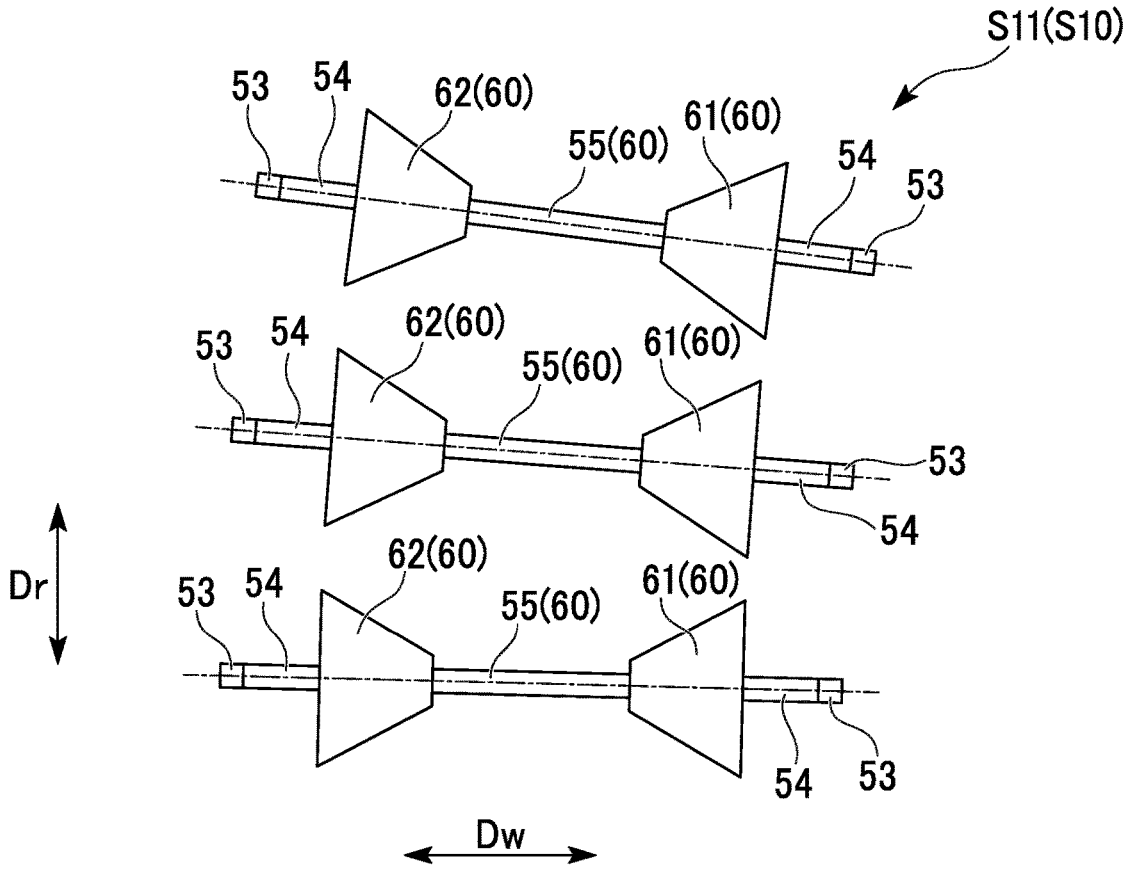
FIG. 5A is a top view illustrating a manner in which the first travel path forming units are arranged in a track constructing method according to the first embodiment when the manner in which the first travel path forming units are arranged is viewed from the upper side.
Figure 5B:
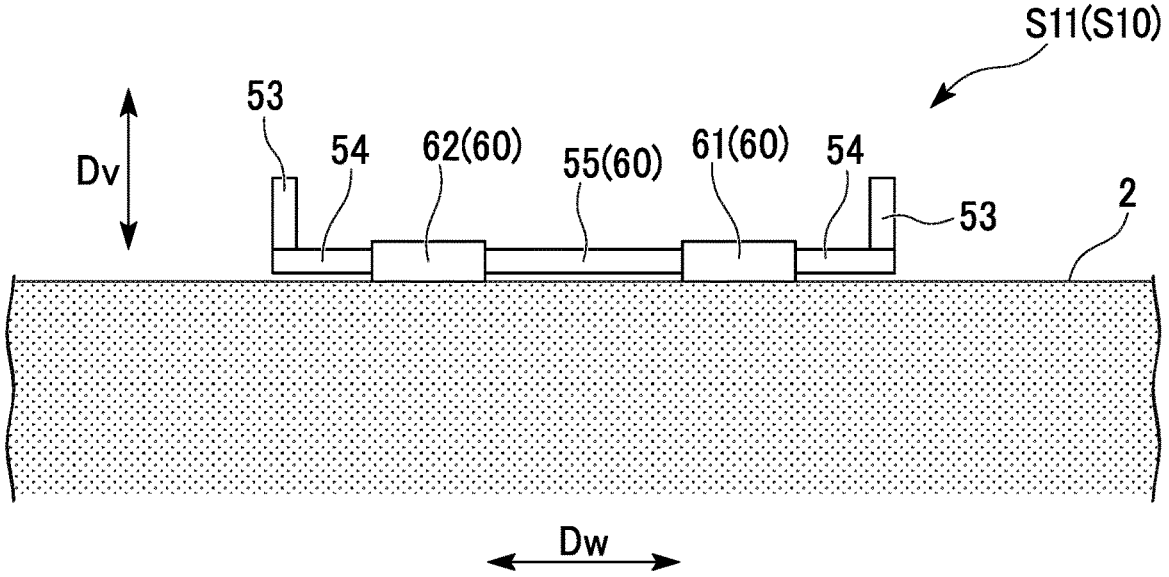
FIG. 5B is a sectional view illustrating a manner in which one first travel path forming unit is arranged in the track constructing method according to the first embodiment when the manner in which the first travel path forming unit is arranged is viewed from the front side in a travel direction.

In the first arrangement step S11, as illustrated in FIGS. 5A and 5B, a plurality of first travel path forming units 60 are arranged to be separated from each other in the travel direction Dr. In the first arrangement step S11, the first travel path forming units 60 to which the guide posts 53 and the support members 54 are fixed are arranged directly on the road bed 2 depending on the shape of the track 1 to be laid. In the first arrangement step S11, a plurality of first travel path forming units 60 are arranged at intervals in the travel direction Dr. In the first arrangement step S11 in this embodiment, a plurality of first travel path forming units 60 are arranged at intervals greater than the length in the travel direction Dr of the second travel path forming unit 70 in the travel direction Dr.

Figure 6:
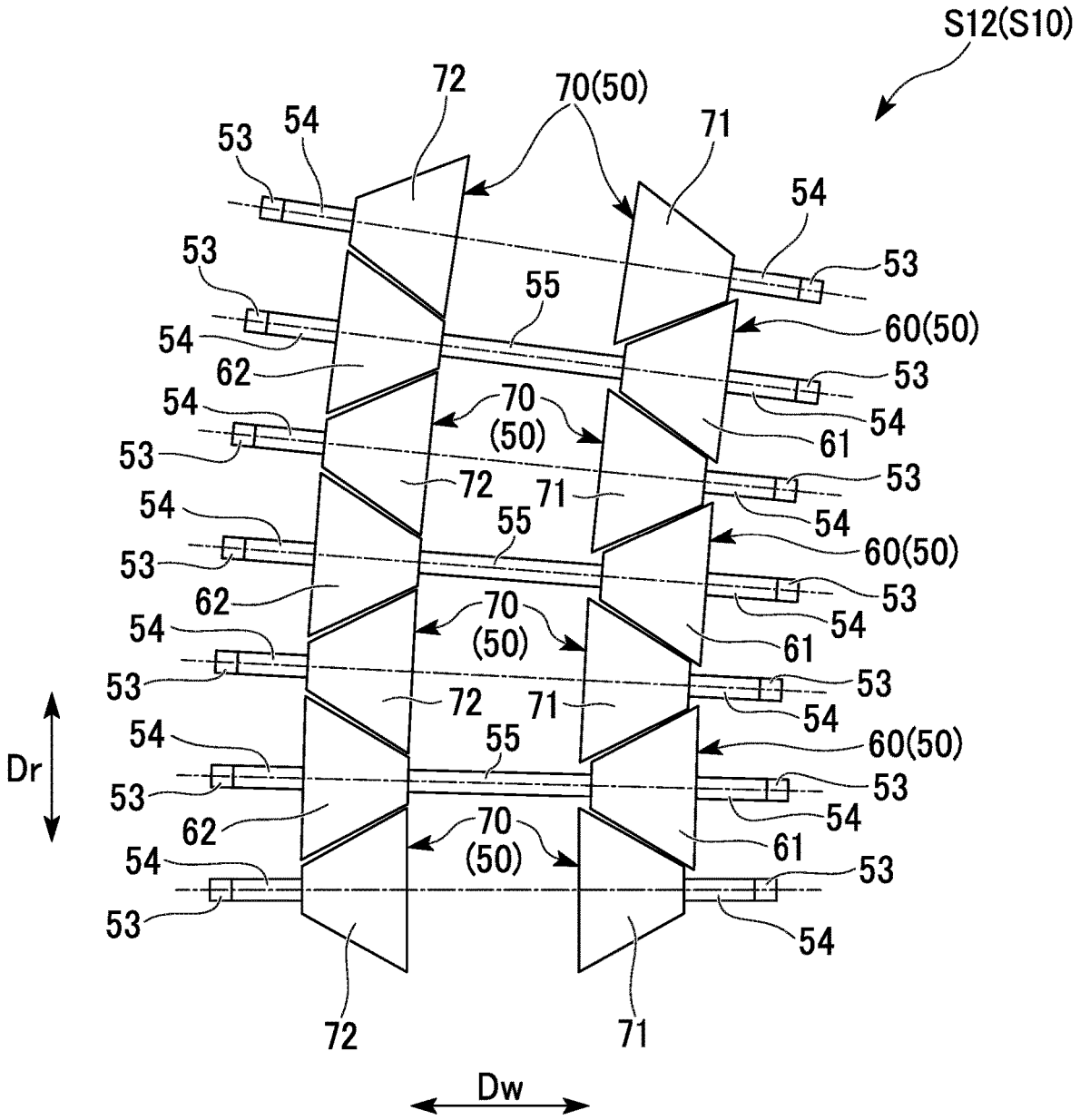
FIG. 6 is a top view illustrating a manner in which second travel path forming units are arranged in the track constructing method according to the first embodiment.

In the second arrangement step S12, as illustrated in FIG. 6, one second travel path forming unit 70 is arranged between two first travel path forming units 60 in the travel direction Dr after the first arrangement step S11. In each second travel path forming unit 70 in this embodiment, the (1B)-th plate 71 and the (2B)-th plate 72 are independent from each other. Accordingly, in the second arrangement step S12, the (1B)-th plate 71 and the (2B)-th plate 72 to which the guide post 53 and the support member 54 are fixed are separately arranged. Specifically, in the second arrangement step S12, the (1B)-th plate 71 is arranged between two (1A)-th plates 61 which are arranged separated from each other in the travel direction Dr. Accordingly, the (1B)-th plate 71 is arranged with a slight gap from a pair of (1A)-th plates 61 in a state in which the convex portion 521 is fitted to the concave portion 522. In the second arrangement step S12, the (2B)-th plate 72 is arranged between two (2A)-th plates 62 which are arranged separated in the travel direction Dr from each other. Accordingly, the (2B)-th plate 72 is arranged with a slight gap from a pair of (2A)-th plates 62 in a state in which the convex portion 521 is fitted to the concave portion 522.

In the position adjusting step S20, the slopes of a plurality of unit travel faces 51*a* with respect to the road bed 2 are adjusted together. The position adjusting step S20 in this embodiment is performed after the arrangement step S10. In the position adjusting step S20, the slopes of the guide rails 8 with respect to the road bed 2 are adjusted. The position adjusting step S20 in this embodiment includes a guide rail fixing step S21 and a travel path forming unit lifting step S22.

Figure 7:
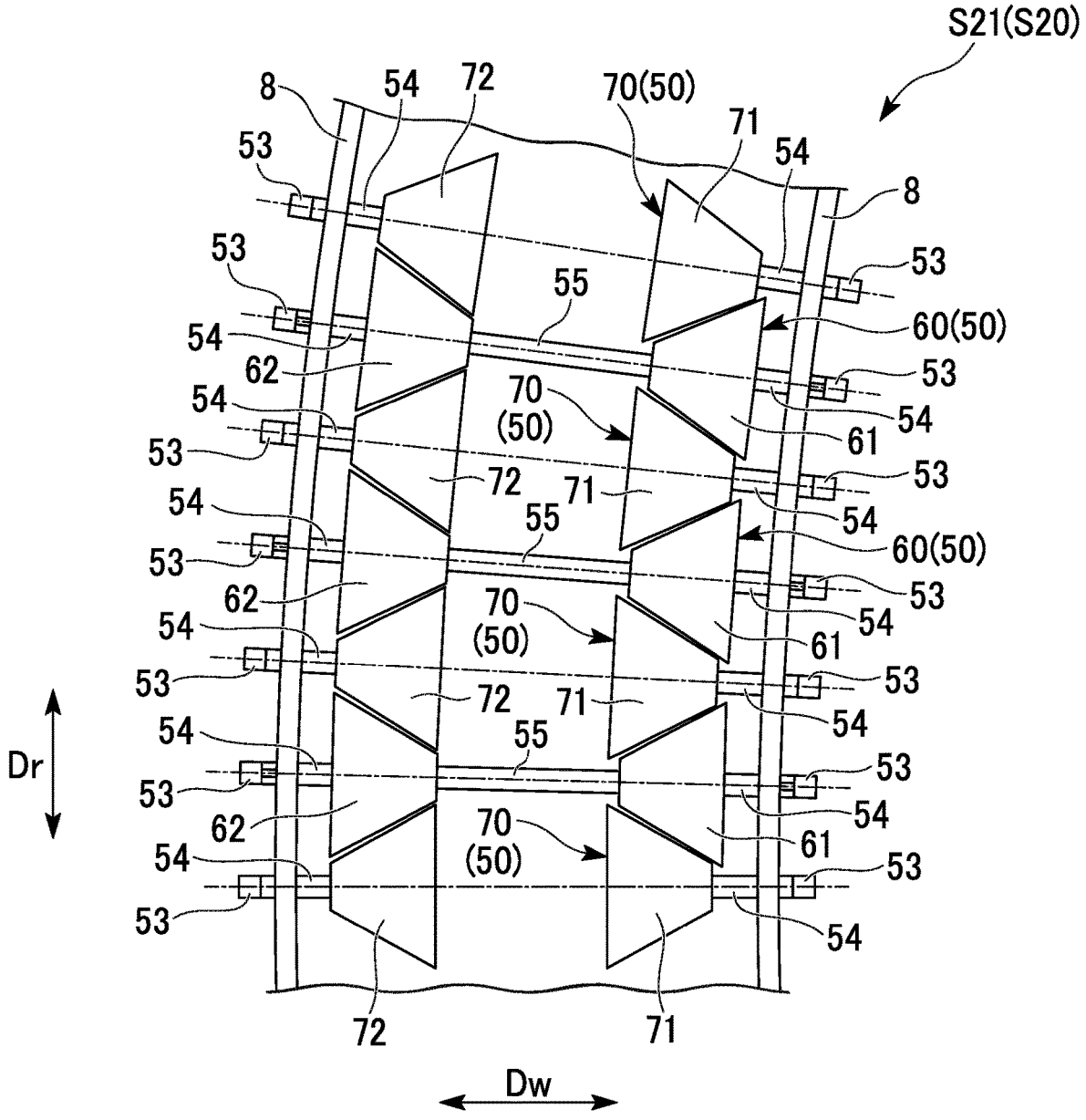
FIG. 7 is a top view illustrating a state in which guide rails are fixed to the first travel path forming units in the track constructing method according to the first embodiment.

In the guide rail fixing step S21, as illustrated in FIG. 7, the guide rails 8 are fixed to a plurality of guide posts 53 after the second arrangement step S12. In the guide rail fixing step S21, positions in the travel direction Dr of the (1A)-th plate 61 and the (2A)-th plate 62 of the first travel path forming unit 60 and the (1B)-th plate 71 and the (2B)-th plate 72 of the second travel path forming unit 70 are adjusted such that the positioning unit 52 of the second travel path forming unit 70 and the positioning unit 52 of the first travel path forming unit 60 are connected, and then the guide rails 8 are fixed thereto. In the guide rail fixing step S21 in this embodiment, the guide rails 8 are fixed to the guide ports 53 of the first travel path forming unit 60. In the guide rail fixing step S21 in this embodiment, the guide rails 8 are temporarily fixed to the guide posts 53 of the second travel path forming unit 70. That is, in the guide rail fixing step S21 in this embodiment, only the positions of the first travel path forming unit 60 and the guide rails 8 are completely fixed.

Figure 8:
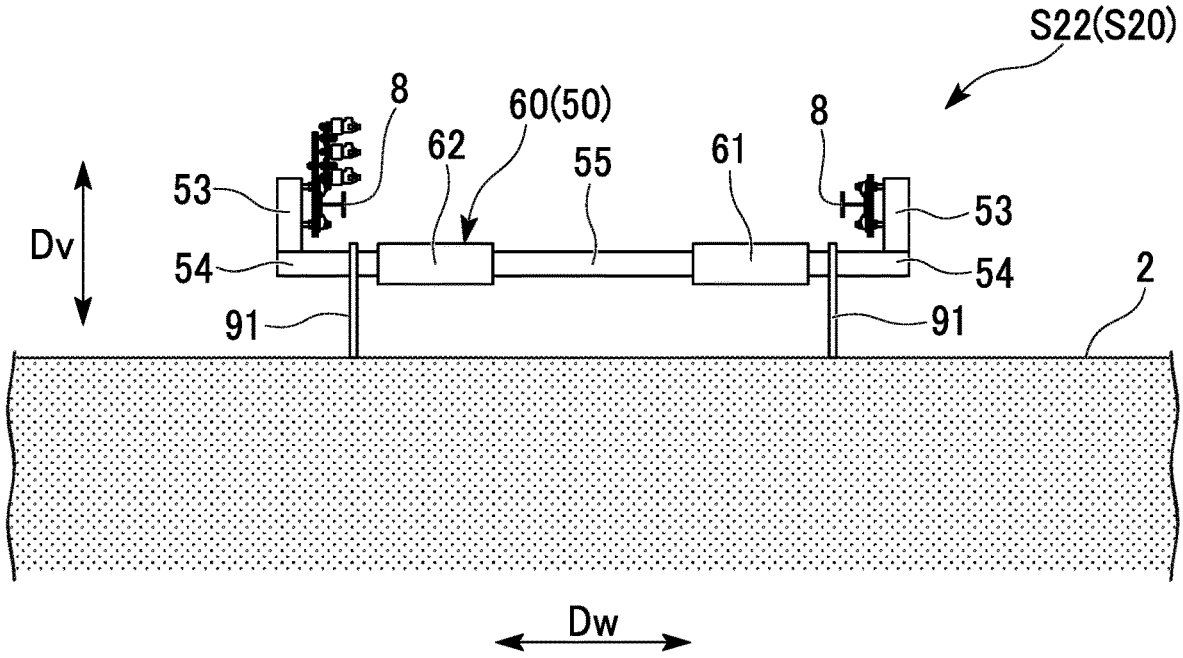
FIG. 8 is a sectional view illustrating a state in which the guide rails are lifted from a road bed in the track constructing method according to the first embodiment.

In the travel path forming unit lifting step S22, as illustrated in FIG. 8, the travel path forming unit 50 is lifted from the road bed 2. The travel path forming unit lifting step S22 in this embodiment is performed after the guide rail fixing step S21. In the travel path forming unit lifting step S22, jack-up members 91 having a height adjusting function is attached to the support members 54 on both sides in the width direction Dw and the travel path forming unit 50 is lifted in parallel to the road bed 2 for each support member 54. In this embodiment, the support member 54 of the first travel path forming unit 60 and the support member 54 of the second travel path forming unit 70 are lifted by the jack-up members 91. The jack-up member 91 is a screw rod for mounting adjustment that is attachable to and detachable from the support member 54.

Figure 9:
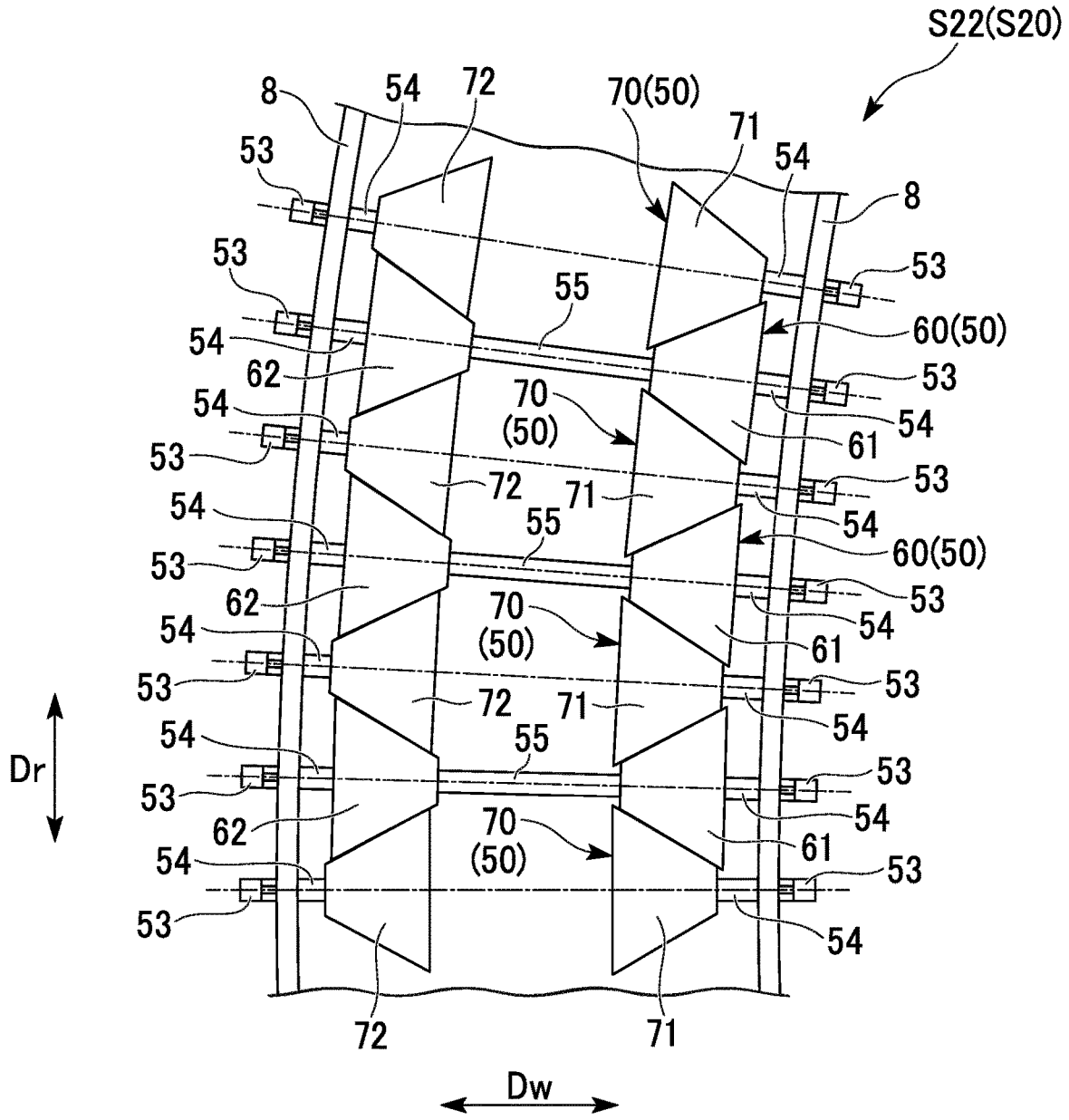
FIG. 9 is a top view illustrating a state in which guide rails are fixed to the second travel path forming units in the track constructing method according to the first embodiment.

In the travel path forming unit lifting step S22, the positions of the guide rails 8 are adjusted such that the guide rails 8 are substantially parallel to the road bed 2 in a state in which the first travel path forming unit 60 and the second travel path forming unit 70 are lifted. In the travel path forming unit lifting step S22, as illustrated in FIG. 9, the second travel path forming unit 70 is fixed to the guide rails 8 after the positions of the guide rails 8 are determined. Accordingly, the position of the second travel path forming unit 70 is fixed in a state in which the inclined face 51*b* is in contact with the first travel path forming unit 60. In the travel path forming unit lifting step S22, the guide posts 53 of the first travel path forming unit 60 are fixed to the guide rails 8. Accordingly, the slopes of the unit travel faces 51*a* of the first travel path forming units 60 with respect to the road bed 2 are adjusted together.

In the travel path forming unit lifting step S22 in this embodiment, the first travel path forming unit 60 and the second travel path forming unit 70 are lifted together, but the invention is not limited thereto. That is, since the first travel path forming unit 60 and the second travel path forming unit 70 are connected to each other by the positioning unit 52, only one of the first travel path forming unit 60 and the second travel path forming unit 70 may be lifted in the travel path forming unit lifting step S22. At this time, in the travel path forming unit lifting step S22, it is preferable that the support member 54 of the first travel path forming unit 60 to which the guide rail 8 is fixed be lifted.

Figure 10:
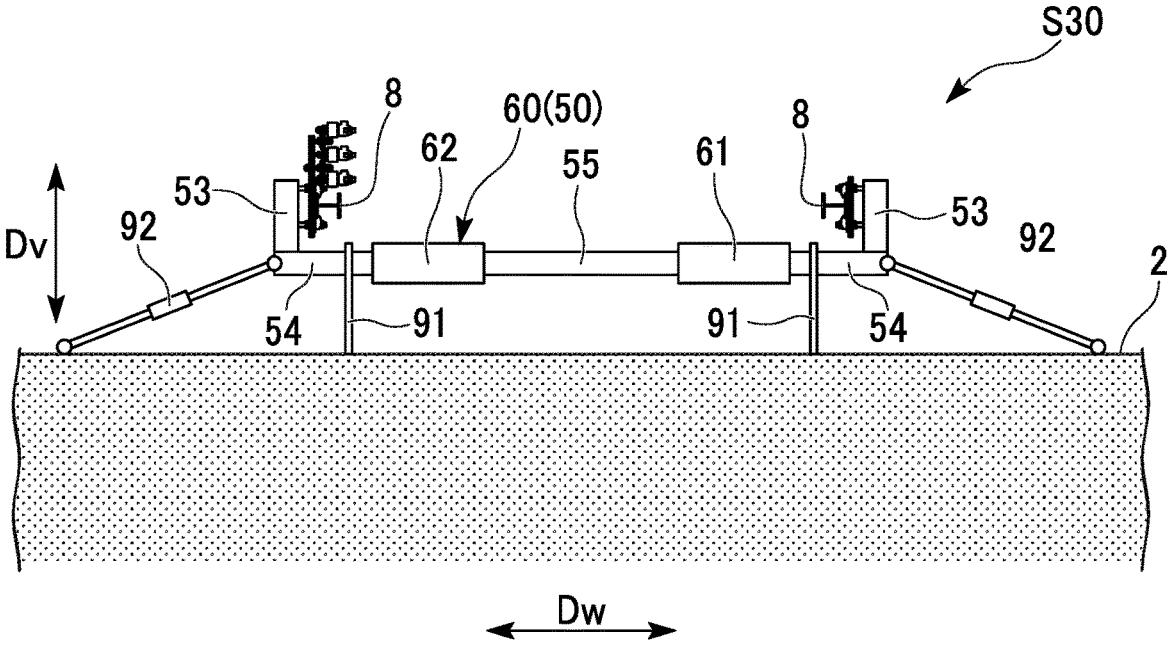
FIG. 10 is a sectional view illustrating a state in which positions of the first travel path forming units and the second travel path forming units are fixed in the track constructing method according to the first embodiment.
Figure 11:
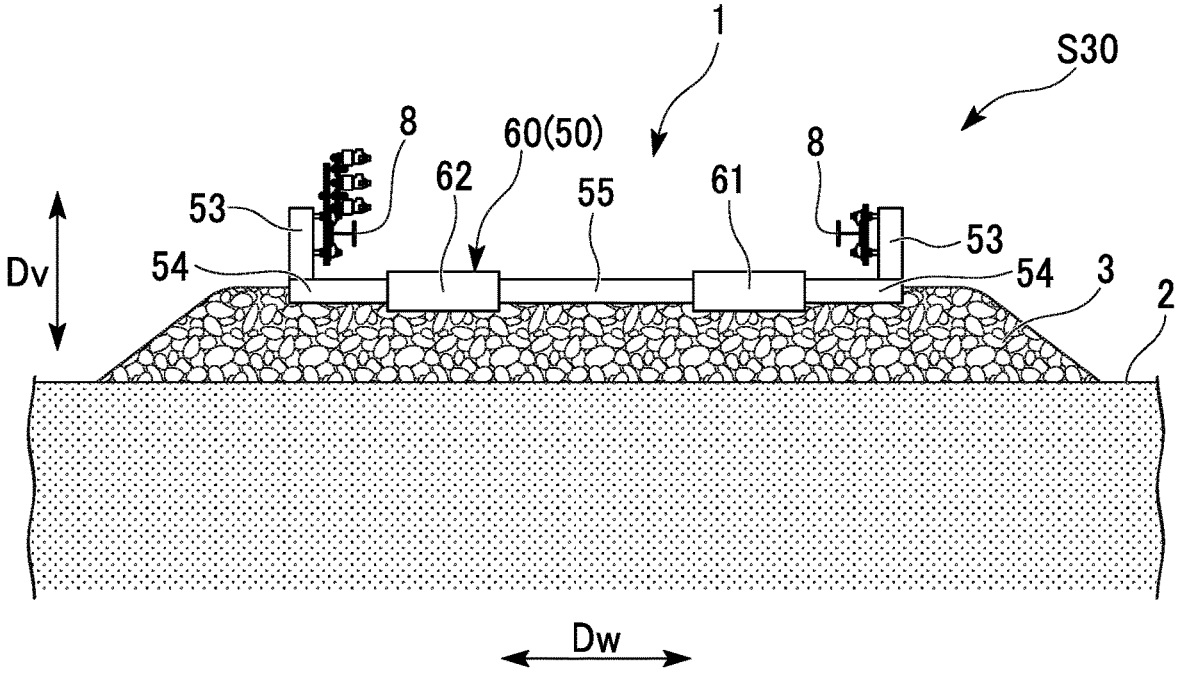
FIG. 11 is a sectional view illustrating a state in which ballast has been loaded in the track constructing method according to the first embodiment.

The travel path forming unit fixing step S30 is performed after the position adjusting step S20. In the travel path forming unit fixing step S30, ballast 3 is loaded between the travel path forming unit 50 and the road bed 2, and the position of the travel path forming unit 50 relative to the road bed 2 is fixed. In the travel path forming unit fixing step S30 in this embodiment, as illustrated in FIG. 10, a fixing jig 92 is attached to the support member 54 and the travel path forming unit 50 is fixed such that the position such as a height of the travel path forming unit 50 relative to the road bed 2 does not move. Thereafter, in the travel path forming unit fixing step S30, as illustrated in FIG. 11, the ballast 3 is loaded and packed between the travel path forming unit 50 and the road bed 2. In the travel path forming unit fixing step S30, the jack-up members 91 and the fixing jigs 92 are detached from the support members 54 in a state in which the travel path forming unit 50 cannot be moved by the ballast 3.

In the track 1 which has been constructed using the above-mentioned track constructing method, a plurality of first travel path forming units 60 and a plurality of second travel path forming units 70 are alternately arranged in the travel direction Dr. The relative position between the (1A)-th plate 61 and the (1B)-th plate 71 and the relative position between the (2A)-th plate 62 and the (2B)-th plate 72 are fixed by the positioning units 52. Accordingly, the travel face 4 which is continuous in the travel direction Dr can be formed on the right side in the width direction Dw by the (1A)-th formation face 61*a* and the (1B)-th formation face 71*a*. In addition, the travel face 4 which is continuous in the travel direction Dr can be formed on the left side in the width direction Dw by the (2A)-th formation face 62*a* and the (2B)-th formation face 72*a*. Accordingly, even when ground subsidence occurs in part of the road bed 2, it is possible to partially adjust the position of the travel face 4 relative to the road bed by replacing only the travel path forming unit 50 corresponding to the position at which the ground subsidence has occurred or adjusting the position. That is, it is possible to simply perform maintenance of the travel path 5 at low costs for a short time. Accordingly, it is possible to form a track 1 in which the travel wheels 120 can travel directly with easy maintenance.

The positioning unit 52 includes the convex portion 521 formed in the (1A)-th plate 61 and the (2A)-th plate 62 and the concave portions 522 formed in the (1B)-th plate 71 and the (2B)-th plate 72. Accordingly, the positioning unit 52 that fixes the relative position between the neighboring travel path forming units 50 can be formed with a detachable and simple configuration.

Since the travel path forming unit 50 includes the guide posts 53, a plurality of first travel path forming units 60 and a plurality of second travel path forming units 70 can be fixed to the guide rails 8 using the guide posts 53. Accordingly, only by adjusting the positions of the guide rails 8 relative to the road bed 2, the positions of the (1A)-th formation face 61*a* and the (2A)-th formation face 62*a* or the (1B)-th formation face 71*a* and the (2B)-th formation face 72*a* constituting the travel face 4 relative to the road bed 2 can be adjusted. That is, it is possible to adjust the positions of a plurality of unit travel faces 51*a* together without adjusting the positions of a plurality of travel path forming units 50 including the unit travel face 51*a* constituting the travel face 4 relative to the road bed 2. Accordingly, it is possible to form the travel face 4 that extends smoothly in the travel direction Dr on the road bed 2.

The first travel path forming units 60 and the second travel path forming units 70 include the support members 54 to which the guide posts 53 are fixed. Since the support members 54 protrude outward of the travel path forming units 50 in the width direction Dw, the sizes of the (1A)-th plate 61 and the (2A)-th plate 62 and the sizes of the (1B)-th plate 71 and the (2B)-th plate 72 do not need to be large in the width direction Dw in order to install the guide posts 53. Accordingly, it is possible to reduce the manufacturing costs of the travel path forming unit 50.

The first travel path forming unit 60 includes two members such as the (1A)-th plate 61 and the (2A)-th plate 62 which are separated from each other in the width direction Dw. Similarly, the second travel path forming unit 70 includes two members such as the (1B)-th plate 71 and the (2B)-th plate 72 which are separated from each other in the width direction Dw. Accordingly, the travel face 4 on the right side in the width direction Dw and the travel face 4 on the left side in the width direction Dw can be formed of different members. Accordingly, an area between the travel faces 4 which are formed to be separated from each other in the width direction Dw does not need to be formed integrally, and it is possible to further reduce the manufacturing costs of the travel path forming unit 50.

The (1A)-th plate 61 and the (1B)-th plate 71 are connected to each other in a state in which the (1*a*1)-th inclined face 61*b* of the (1A)-th plate 61 and the (1*b*2)-th inclined face 71*c* of the (1B)-th plate 71 are opposed to each other. At the same time, the (1A)-th plate 61 and the (1B)-th plate 71 are connected to each other in a state in which the (1*a*2)-th inclined face 61*c* of the (1A)-th plate 61 and the (1*b*1)-th inclined face 71*b* of the (1B)-th plate 71 are opposed to each other. Accordingly, the boundary between the (1A)-th plate 61 and the (1B)-th plate 71 can be inclined with respect to the travel direction Dr. Similarly, the (2A)-th plate 62 and the (2B)-th plate 72 are connected to each other in a state in which the (2*a*1)-th inclined face 62*b* of the (2A)-th plate 62 and the (2*b*2)-th inclined face 72*c* of the (2B)-th plate 72 are opposed to each other. At the same time, the (2A)-th plate 62 and the (2B)-th plate 72 are connected to each other in a state in which the (2*a*2)-th inclined face 62*c* of the (2A)-th plate 62 and the (2*b*1)-th inclined face 72*b* of the (2B)-th plate 72 are opposed to each other. Accordingly, the boundary between the (2A)-th plate 62 and the (2B)-th plate 72 can be inclined with respect to the travel direction Dr. That is, the joint between the travel path forming units 50 can be inclined with respect to the direction in which the travel wheels 120 enter each travel path forming unit 50. Accordingly, it is possible to curb noise or rattling when the vehicle 100 travels on the joint between the neighboring travel path forming units 50.

The (1*a*1)-th inclined face 61*b* on the front side of the (1A)-th plate 61 in the travel direction Dr and the (1*b*1)-th inclined face 71*b* on the front side of the (1B)-th plate 71 in the travel direction Dr are formed at different angles with respect to the travel direction Dr. Similarly, the (1*a*2)-th inclined face 61*c* on the rear side of the (1A)-th plate 61 in the travel direction Dr and the (1*b*2)-th inclined face 71*c* on the rear side of the (1B)-th plate 71 in the travel direction Dr are formed at different angles with respect to the travel direction Dr. The (2*a*1)-th inclined face 62*b* on the front side of the (2A)-th plate 62 in the travel direction Dr and the (2*b*1)-th inclined face 72*b* on the front side of the (2B)-th plate 72 in the travel direction Dr are formed at different angles with respect to the travel direction Dr. Similarly, the (2*a*2)-th inclined face 62*c* on the rear side of the (2A)-th plate 62 in the travel direction Dr and the (2*b*2)-th inclined face 72*c* on the rear side of the (2B)-th plate 72 in the travel direction Dr are formed at different angles with respect to the travel direction Dr.

Accordingly, since the angles of the inclined face 51*b* (the first inclined face) on the front side and the inclined face 51*b* (the second inclined face) on the rear side in the travel direction Dr are different from each other, conditions when the travel wheels 120 pass can be made to be irregular when the travel wheels 120 enter and leave the first travel path forming unit 60 and the second travel path forming unit 70. Accordingly, it is possible to further curb noise or rattling when the vehicle 100 travels on the joint between the neighboring travel path forming units 50.

The first travel path forming unit 60 and the second travel path forming unit 70 including the inclined faces 51*b* with different angles with respect to the travel direction Dr on the front side and the rear side in the travel direction Dr are arranged to form the travel face 4. Accordingly, it is possible to curb an increase in a gap between the neighboring travel path forming units 50 and to form a curved travel path 5 such as a curved section.

The travel path forming units 50 which are concrete blocks are used. Accordingly, the unit travel faces 51*a* of the travel path forming units 50 are formed of concrete. Accordingly, it is possible to form a concrete travel face 4.

The travel path 5 is disposed directly on the ballast 3. Accordingly, by disposing the ballast 3 between the road bed 2 and the travel path 5, the position of the travel face 4 can be adjusted by adding the ballast 3 as well as adjusting the travel path 5 itself even when the road bed 2 has been distorted due to ground subsidence or the like. Accordingly, it is possible to further reduce maintenance costs for repairing distortion or the like of the travel face 4.

In the track constructing method according to the first embodiment, the positions of the guide rails 8 are adjusted by fixing the guide rails 8 to the guide posts 53 after arranging a plurality of first travel path forming units 60 and a plurality of second travel path forming units 70 in the arrangement step S10. Accordingly, only by adjusting the positions of the guide rails 8 relative to the road bed 2, the positions of the (1A)-th formation faces 61*a* and the (2A)-th formation faces 62*a* or the (1B)-th formation faces 71*a* and the (2B)-th formation faces 72*a* constituting the travel face 4 relative to the road bed 2 can be adjusted together. That is, it is possible to adjust the positions of a plurality of unit travel faces 51*a* together without adjusting the positions of a plurality of travel path forming units 50 including the unit travel faces 51*a* constituting the travel face 4 relative to the road bed 2. Accordingly, it is possible to form the travel face 4 that extends smoothly in the travel direction Dr on the road bed 2.

By lifting the (1A)-th plate 61, the (2A)-th plate 62, the (1B)-th plate 71, and the (2B)-th plate 72 from the road bed 2 after the guide rail fixing step S21 of fixing the guide rails 8 to the guide posts 53, it is not necessary to individually lift a plurality of travel path forming units 50. Accordingly, it is possible to simplify the steps for providing the ballast 3 between a plurality of travel path forming units 50 and the road bed 2.

In the track constructing method according to this embodiment, the first travel path forming units 60 and the second travel path forming units 70 are continuously arranged before fixing the guide rails 8 as in the first arrangement step S11 and the second arrangement step S12, but the invention is not limited to this sequence. In the track constructing method, for example, the second travel path forming units 70 may be arranged and fixed to the guide rails 8 after the first arrangement step S11 is performed and then the guide rail fixing step S21 or the position adjusting step S20 is performed to fix the guide rails 8 to the first travel path forming units 60 and to adjust the positions thereof.

The convex portion 521 and the concave portion 522 of the positioning unit 52 in the first embodiment are not limited to a shape in which they extend in the width direction Dw. The convex portion 521 and the concave portion 522 may extend in the vertical direction Dv and may be formed at the centers of the inclined faces 51*b* in the width direction Dw.

Figure 12:
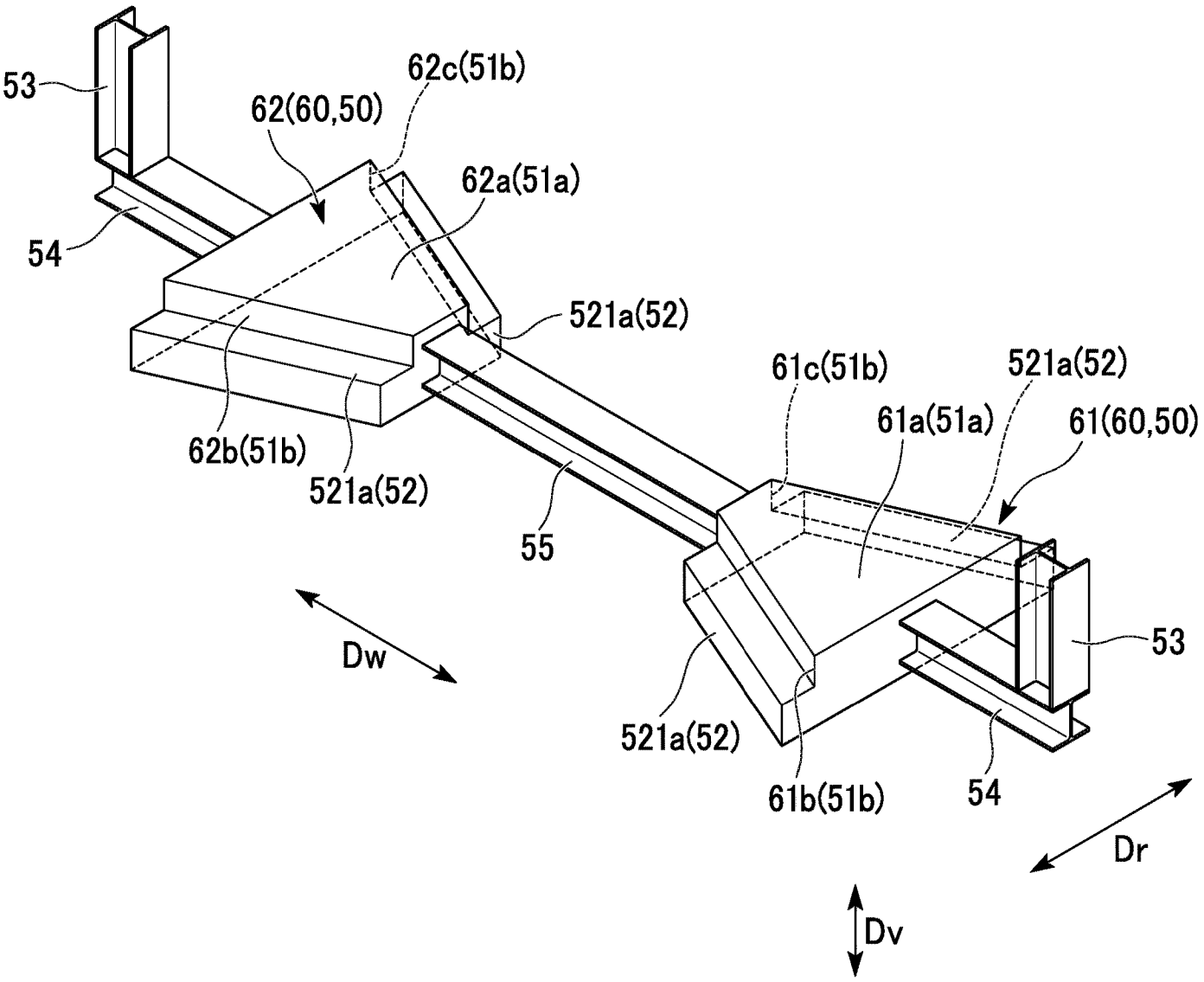
FIG. 12 is a perspective view illustrating a convex portion according to a modified example of the first embodiment.
Figure 13:
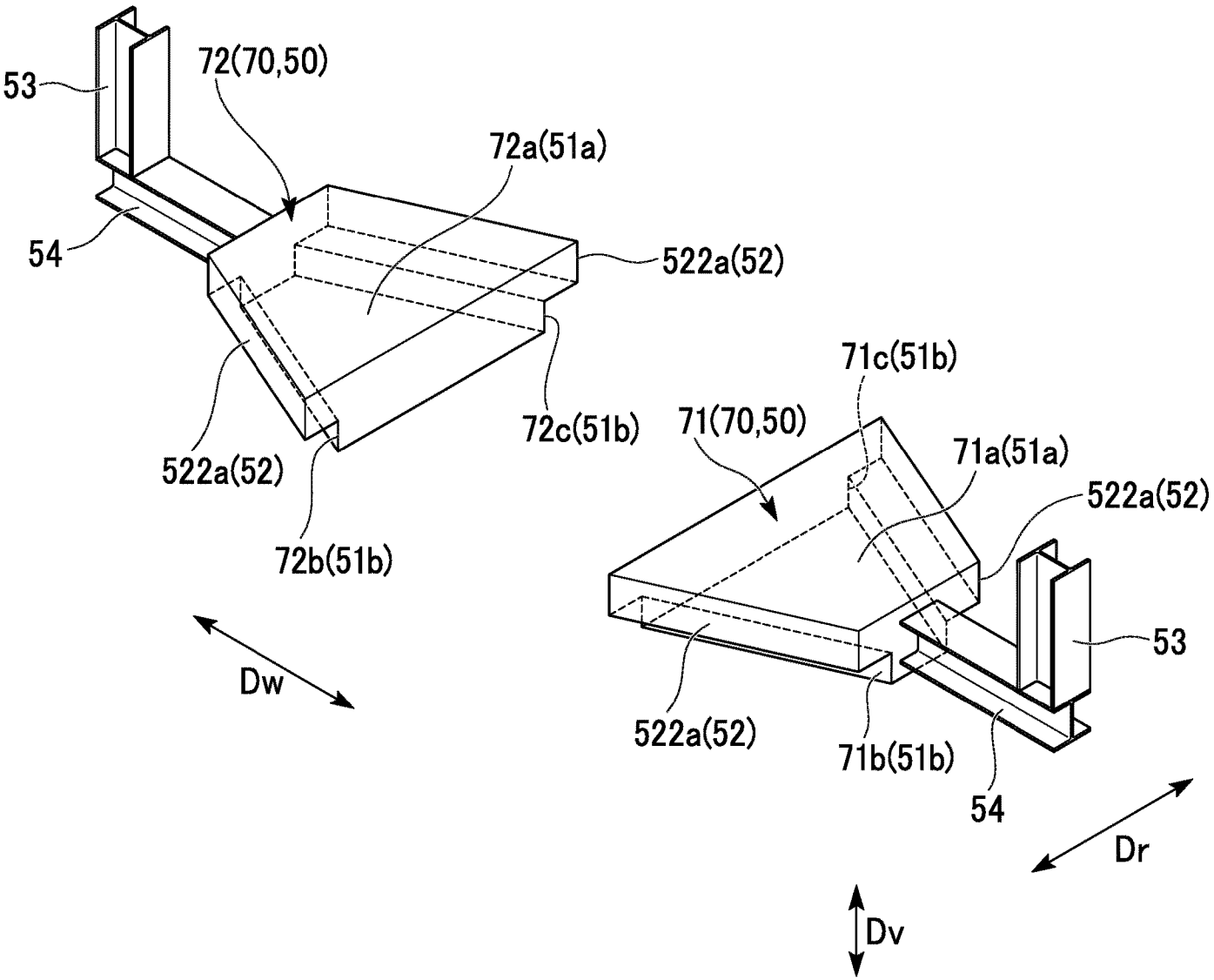
FIG. 13 is a perspective view illustrating a concave portion according to the modified example of the first embodiment.

For example, as illustrated in FIGS. 12 and 13 as a modified example, the convex portion 521 and the concave portion 522 of the positioning unit 52 may be formed in contact with a face facing one side in the vertical direction Dv of the first travel path forming unit 60 and the second travel path forming unit 70 such that the sectional shape thereof is an L shape.

Specifically, as illustrated in FIG. 12, a convex portion 521*a* in the modified example is formed in the (1*a*1)-th inclined face 61*b* and the (1*a*2)-th inclined face 61*c* of the (1A)-th plate 61 and the (2*a*1)-th inclined face 62*b* and the (2*a*)-th inclined face 62*c* of the (2A)-th plate 62. The face facing the lower side in the vertical direction of the convex portion 521*a* is formed integrally with the face facing the lower side in the vertical direction of the (1A)-th plate 61 or the (2A)-th plate 62. The face facing the upper side in the vertical direction of the convex portion 521*a* forms a stepped portion from the (1A)-th formation face 61*a* or the (2A)-th formation face 62*a*.

As illustrated in FIG. 13, a concave portion 522*a* in the modified example is formed in the (1*b*1)-th inclined face 71*b* and the (1*b*2)-th inclined face 71*c* of the (1B)-th plate 71 and the (2*b*1)-th inclined face 72*b* and the (2*b*2)-th inclined face 72*c* of the (2B)-th plate 72. The face facing the upper side in the vertical direction of the concave portion 522*a* is formed integrally with the (1B)-th formation face 71*a* or the (2B)-th formation face 72*a*. The face facing the lower side in the vertical direction of the concave portion 522*a* forms a stepped portion from the face facing the lower side in the vertical direction of the (1B)-th plate 71 or the (2B)-th plate 72. As a result, since the first travel path forming unit 60 and the second travel path forming unit 70 are arranged in the travel direction Dr, the face facing the lower side in the vertical direction of the concave portion 522*a* is arranged to oppose the face facing the upper side in the vertical direction of the convex portion 521*a*.

The convex portion 521 and the concave portion 522 are not limited to the structure in which they are separately formed in the first travel path forming unit 60 and the second travel path forming unit 70. For example, in one travel path forming unit 50, the convex portion 521 may be formed in the inclined face 51*b* on the front side in the travel direction Dr and the concave portion 522 may be formed in the inclined face 51*b* on the rear side in the travel direction Dr. In the first plate 511 and the second plate 512, the convex portion 521 and the concave portion 522 may be formed at different positions in the travel direction Dr.

Second Embodiment

Figure 14:
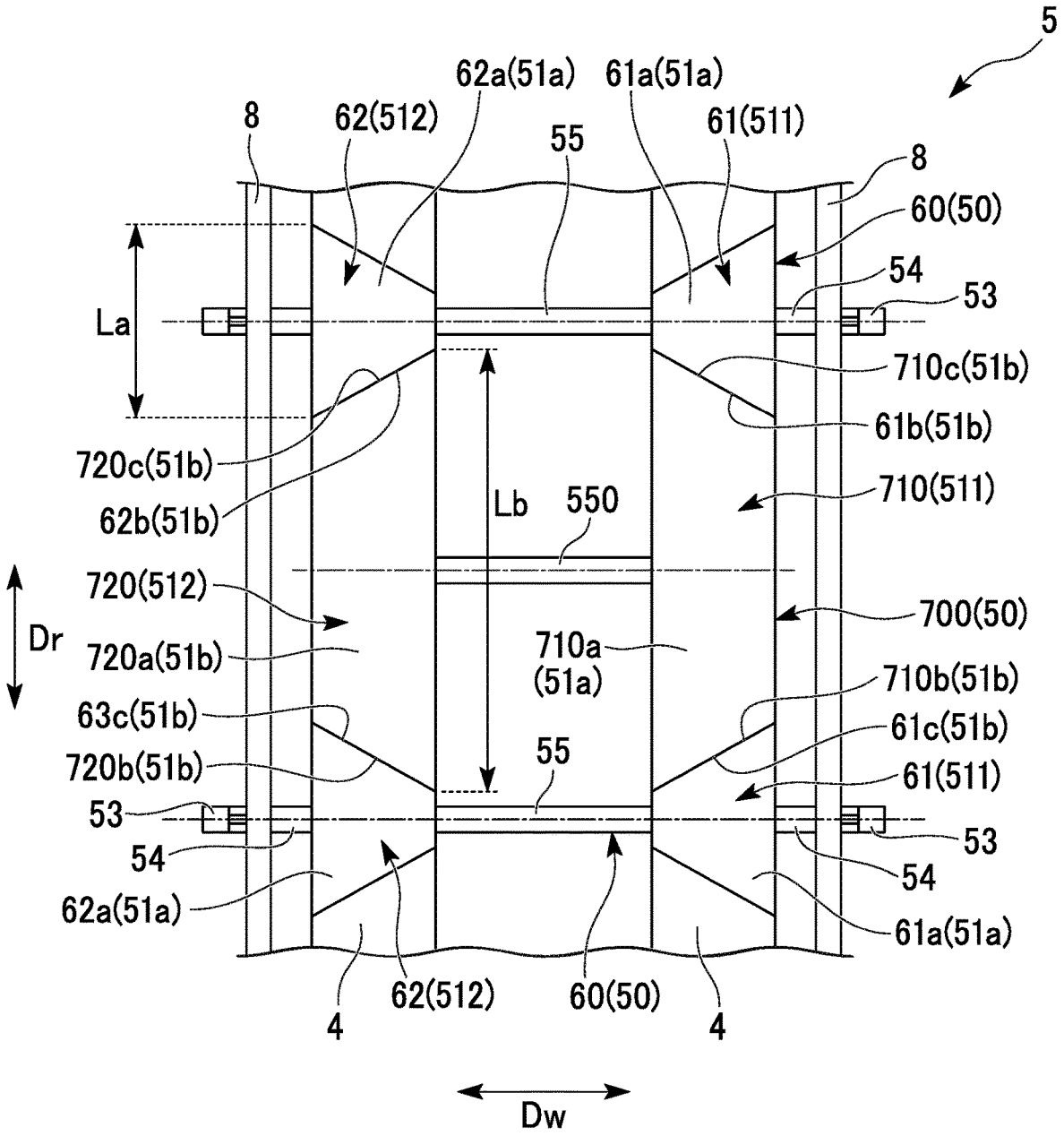
FIG. 14 is a top view illustrating a travel path according to a second embodiment.

A track according to a second embodiment will be described below with reference to FIG. 14.

In the second embodiment, the same elements as in the first embodiment will be referenced by the same reference signs and detailed description thereof will not be repeated. The track 1 according to the second embodiment is different from the track according to the first embodiment in the shape of a second travel path forming unit 700.

That is, in the second travel path forming unit 700 in the track 1 according to the second embodiment, the length in the travel direction Dr is larger than the length of the first travel path forming unit 60 in the travel direction Dr. Specifically, in the second travel path forming unit 700, a part Lb having the largest length of the (1B)-th plate 710 in the travel direction Dr is formed to be longer than a part La having the largest length in the travel direction Dr of the (1A)-th plate 61 of the first travel path forming unit 60. In the second travel path forming unit 700, the parts Lb having the largest length in the travel direction Dr of the (1B)-th plate 710 and the (2B)-th plate 720 are formed to have the same length.

In the second travel path forming unit 700, the (1B)-th plate 710 and the (2B)-th plate 720 are connected to each other by a connection member 550. In the second travel path forming unit 700, the concave portion 522 is formed as the positioning unit 52 similarly to the first embodiment. The second travel path forming unit 700 according to the second embodiment is not connected to the support member 54 and the guide post 53 unlike the first embodiment.

In the track 1 according to the second embodiment, it is possible to decrease the number of travel path forming units 50 which are used in a straight section and to form the travel face 4 by increasing the distance in the travel direction Dr using the second travel path forming unit 700. Accordingly, it is possible to reduce manufacturing costs for laying the track 1. It is also possible to reduce the number of travel path forming units 50 of which the position should be adjusted at the time of maintenance. Accordingly, it is possible to efficiently perform maintenance of the travel face 4.

The (1A)-th plate 61 and the (2A)-th plate 62 of the first travel path forming unit 60 according to the first embodiment and the second embodiment are not limited to the trapezoidal shape. The (1A)-th plate 61 and the (2A)-th plate 62 may include the inclined face 51*b*. Accordingly, the (1A)-th plate 61 and the (2A)-th plate 62 may form a rhomboidal shape or a parallelogrammic shape. Similarly, the (1B)-th plate 71 and the (2B)-th plate 72 of the second travel path forming unit 70 are not limited to the trapezoidal shape. The (1B)-th plate 71 and the (2B)-th plate 72 may include the inclined face 51*b*. Accordingly, the (1B)-th plate 71 and the (2B)-th plate 72 may form a rhomboidal shape or a parallelogrammic shape.

Figure 15:
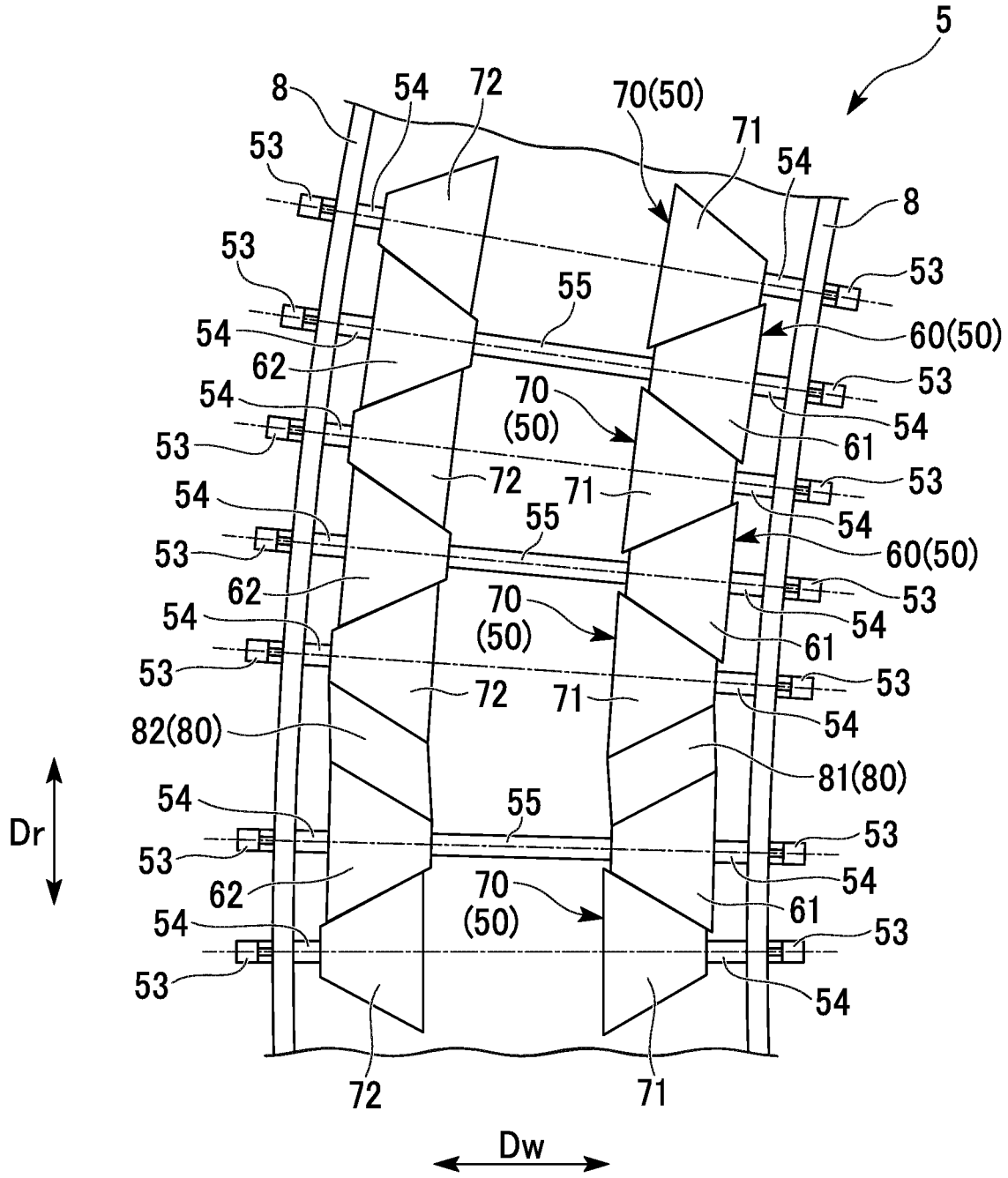
FIG. 15 is a top view illustrating a travel path according to a modified example of the first embodiment and the second embodiment.

The travel path 5 according to the first embodiment and the second embodiment has a structure in which the first travel path forming unit 60 and the second travel path forming unit 70 or 700 are alternately arranged in the travel direction, but is not limited thereto. For example, the travel path 5 may include a travel path forming unit with another shape between the first travel path forming unit 60 and the second travel path forming unit 70 or 700. Specifically, as illustrated in FIG. 15, an adjustment plate (a travel path forming unit) 80 including an inclined face 51*b* may be provided as a travel path forming unit between a certain first travel path forming unit 60 and a second travel path forming unit 70 in the first embodiment. In FIG. 15, the adjustment plate 80 has a parallelogrammic shape, but may have a rhomboidal shape or a trapezoidal shape as long as it includes the inclined face 51*b*.

Third Embodiment

A track according to a third embodiment will be described below with reference to FIGS. 16 and 17.

In the third embodiment, the same elements as in the first embodiment and the second embodiment will be referenced by the same reference signs and detailed description thereof will not be repeated. The track 1 according to the third embodiment is different from those in the first embodiment and the second embodiment in that the travel face 4 is formed on an iron rail 42.

Figure 16:
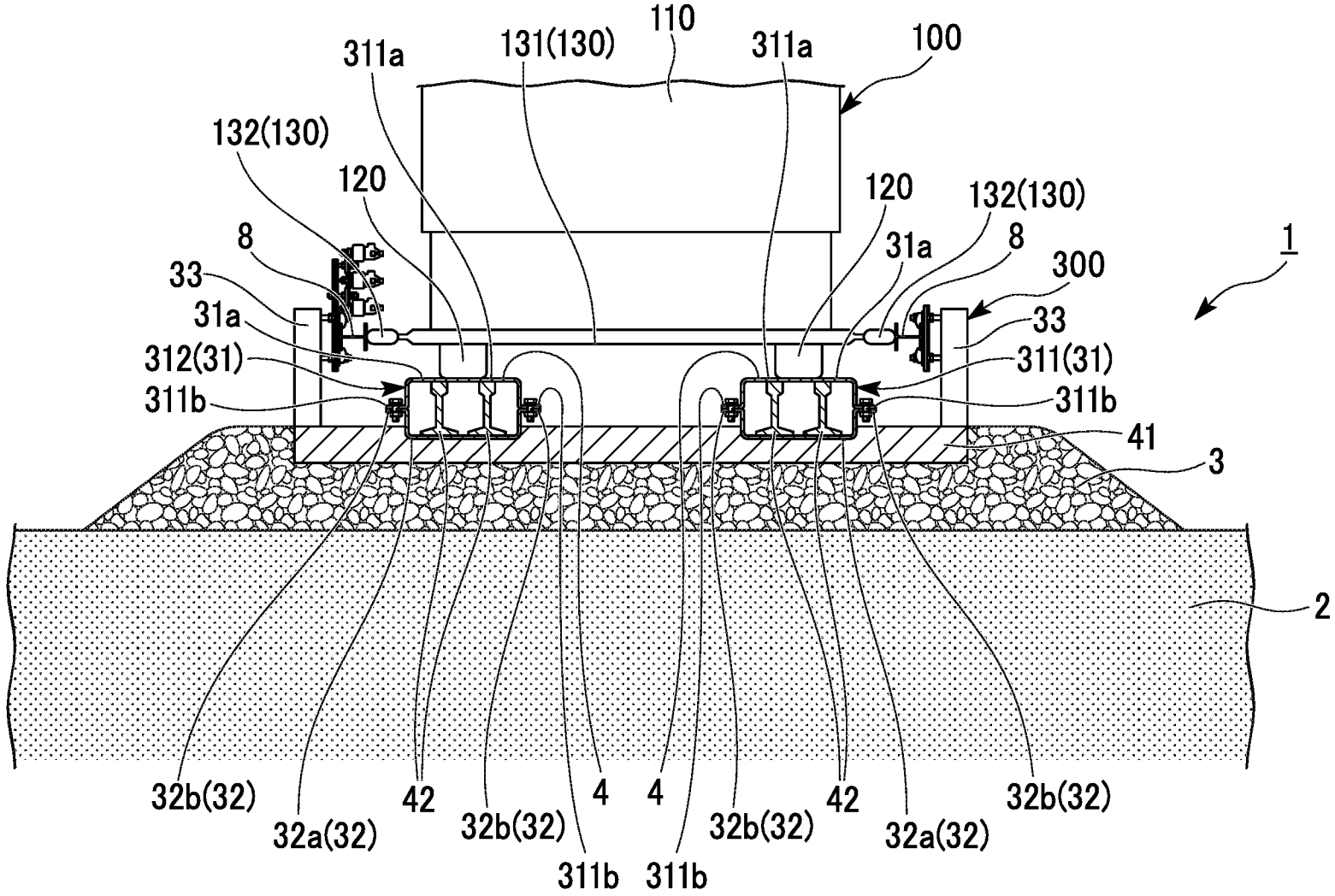
FIG. 16 is a sectional view illustrating a track and a vehicle according to a third embodiment.
Figure 17:
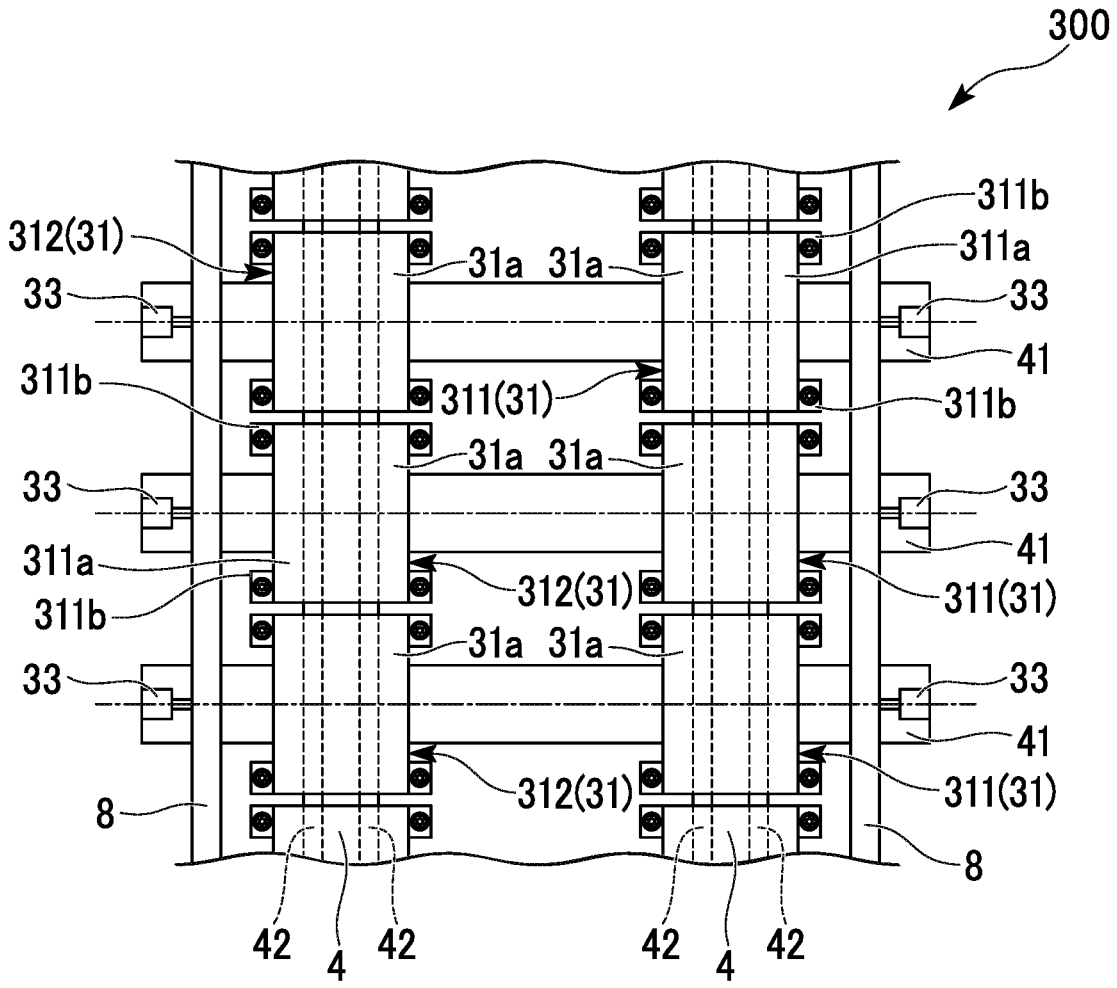
FIG. 17 is a top view illustrating a travel path according to the third embodiment.

That is, as illustrated in FIG. 16, the track 1 according to the third embodiment is different from that in the first embodiment in the travel path forming unit. In the track 1 according to the third embodiment, a travel face 4 is formed by a travel path 300 which is arranged on the road bed 2 with a crosstie 41 and an iron rail 42 in addition to the ballast 3 interposed therebetween. That is, the travel path 300 is disposed on the rail 42 of a ballast track disposed on the road bed 2.

The crosstie 41 is embedded in the ballast 3. A plurality of crossties 41 are arranged separated from each other in the travel direction Dr over the total extension of the track 1.

The rail 42 is installed on the crossties 41. The rail 42 extends in the travel direction Dr over the total extension of the track 1. In this embodiment, two rails 42 are arranged for each travel face 4. The two rails 42 are arranged separated from each other in the width direction Dw. That is, in this embodiment, total four rails 42 are arranged by adding two rails to a pair of rails 42 which is provided as the ballast track.

The travel path 30 includes travel path forming units 31 which are arranged adjacent to each other in the travel direction Dr of the vehicle 100. The travel path 30 also includes positioning units 32 and guide posts 33.

The travel path forming units 31 are arranged on the road bed 2 with the rails 42 interposed therebetween. Each travel path forming unit 31 includes a unit travel face 31*a* that can partially form the travel face 4. The unit travel face 31*a* is formed in the travel path forming unit 31 such that it faces the upper side in the vertical direction Dv when the travel path forming unit 31 is disposed on the rails 42. The unit travel face 31*a* in the third embodiment has a rectangular shape when viewed in the vertical direction Dv. That is, the travel face 4 in the third embodiment is formed by continuously arranging the unit travel faces 31*a* in the travel direction Dr in a state in which a plurality of travel path forming units 31 are arranged in parallel in the travel direction Dr such that the unit travel faces 31*a* are provided on the rails 42. The travel path forming unit 31 in the third embodiment is a plate-shaped member which is formed of a metal material such as a steel plate having higher strength than that of concrete. Each travel path forming unit 31 in the third embodiment includes a first plate 311 with which only the travel wheel 120 on the right side in the width direction Dw comes in contact and a second plate 312 with which only the travel wheel 120 on the left side in the width direction Dw comes in contact.

The first plate 311 in the third embodiment includes a plate body 311*a* and a plate fixing portion 311*b*.

The plate body 311*a* has a rectangular box shape so as to cover the rails 42 from the upper side in the vertical direction Dv.

The plate fixing portion 311*b* is detachably fixed to the positioning unit 32 which will be described later using a bolt. The plate fixing portion 311*b* is formed integrally with the plate body 311*a*. The plate fixing portion 311*b* protrudes outward in the width direction Dw from an open end of the plate body 311*a* with respect to the rails 42.

The second plate 312 in the third embodiment is formed in the same shape as the first plate 311.

The positioning units 32 in the third embodiment fix the relative position between the neighboring travel path forming unit 31 by detachably fixing the travel path forming unit 31 to the crossties 41. The positioning units 32 in the third embodiment are detachably fixed to the travel path forming units 31 using fastening members such as bolts. Each positioning unit 32 includes a positioning body 32*a* and a positioning body fixing portion 32*b*.

The positioning body 32*a* is fixed to the crosstie 41. The positioning body 32*a* is disposed to be interposed between the crosstie 41 and the rails 42. The positioning body 32*a* has a rectangular box shape to cover the rails 42 from the lower side in the vertical direction Dv.

The positioning body fixing portion 32*b* is detachably fixed to the plate fixing portion 311*b* using a bolt. The positioning body fixing portion 32*b* is formed integrally with the positioning body 32*a*. The positioning body fixing portion 32*b* protrudes outward in the width direction Dw from an open end of the positioning body 32*a* with respect to the rails 42. That is, the positioning unit 32 has a shape which is symmetric in the vertical direction Dv with respect to the travel path forming unit 31.

The guide post 33 in the third embodiment is fixed directly to the crosstie 41 and extends in a direction crossing the unit travel face 31*a*. The guide post 33 in the third embodiment has the same structure as the guide post 33 in the first embodiment.

In a track constructing method of laying the track 1 according to the third embodiment, for example, rails 42 are additionally laid on a general ballast track on which two rails 42 have been already laid. Specifically, in a step of performing preparation in advance, additional rails 42 are arranged in the width direction Dw of the rails 42 which have been already laid. Accordingly, a set of rails 42 which are arranged close to each other in the width direction Dw is arranged at positions separated in the width direction Dw from each other on the crosstie 41. Thereafter, the positioning unit 32 is arranged on every multiple crossties 41. The positioning unit 32 is fixed to the crossties 41 in a state in which it is interposed between the rails 42 and the crossties 41. Thereafter, in a position adjusting step, the slope of the rails 42 with respect to the road bed 2 is adjusted.

After the slope of the rails 42 has been adjusted, a plurality of travel path forming units 31 are arranged in the travel direction Dr on the rails 42. By fixing the travel path forming units 31 arranged on the rails 42 to the positioning units 32 using bolts, the adjacent travel path forming units 31 are connected to each other by the positioning unit 32, and a plurality of travel path forming units 31 are arranged in the travel direction Dr.

With the track 1 according to the third embodiment, it is possible to form the travel face 4 using the rails 42. That is, it is possible to form the travel face 4 on the rails 42 of which the slope with respect to the road bed 2 has been adjusted, for example, using the ballast track on which the rails 42 have been already formed. Accordingly, without adjusting the positions of a plurality of travel path forming units 31 including the unit travel face 31*a* relative to the road bed 2, it is possible to adjust the positions of a plurality of unit travel faces 31*a* together. Accordingly, it is possible to form the travel face 4 that extends smoothly in the travel direction on the road bed 2.

In the track 1 according to the third embodiment, four rails 42 are used, but the invention is not limited to this structure. For example, like a general ballast track, only two rails 42 have only to be separated from each other in the width direction Dw. In the case of this structure, the track 1 in which a guide rail type railroad vehicle travels can be formed using a ballast track which has been already laid.

The unit travel face 31*a* in the third embodiment may have a trapezoidal shape similarly to the first embodiment or the second embodiment. That is, the travel path forming units 31 in the third embodiment are not limited to the structure in which an inclined face 51*b* is not formed. For example, the travel path forming units 31 in the third embodiment may have an inclined face 51*b*, which is inclined with respect to the travel direction Dr similarly to the first embodiment, formed therein.

While embodiments of the invention have been described above in detail with reference to the drawings, the elements in the embodiments, the combinations thereof, and the like are only examples and addition, omission, substitution, and other modifications can be added thereto without departing from the gist of the invention. The invention is not limited to the embodiments and is defined by only the appended claims.

The travel path forming unit 31 in the invention is not limited to the structure in which the first plate 311 and the second plate 312 are separated in the width direction Dw from each other. The travel path forming unit 31 has only to have the unit travel face 31*a* formed therein. For example, the travel path forming units 31 may form a shape in which blocks are continuous in the width direction Dw and the travel faces 4 on both sides in the width direction Dw may be formed by a single travel path forming unit 31.

The positioning units 32 in the first embodiment and the second embodiment are not limited to the structure in which the positioning unit is formed integrally with the travel path forming unit 31 like the convex portion 521 and the concave portion 522. For example, in the first embodiment and the second embodiment, the positioning unit 32 may be formed of a member independent from the travel path forming unit 31 as in the third embodiment.

In the embodiments, a track laying method using the travel path forming units has been described, but the invention is not limited to the example in which the travel path forming units 50 and 31 are used to lay the track 1. For example, the travel path forming units 50 and 31 can also be used for a track maintenance method of repairing the laid track 1 by replacing the travel path forming units 50 and 31. Specifically, in the track maintenance method, when ground subsidence occurs in part of the road bed 2, only the travel path forming units 50 and 31 including the unit travel faces corresponding to an area of which the position is partially offset with respect to the whole travel face 4 may be replaced. Here, examples of the area of which the position is partially offset with respect to the whole travel face 4 include a partial area of the travel face 4 in which the position is offset with respect to the road bed 2, a partial area of the travel face 4 on which the position is offset with respect to the guide rails 8, and a partial area of the travel face 4 in which the position is offset with respect to the rails 42. Accordingly, it is possible to partially repair the position of the travel face 4 relative to the road bed 2 by replacing only the travel path forming units 50 and 31 corresponding to a position at which ground subsidence has occurred.

INDUSTRIAL APPLICABILITY

With the track, it is possible to form a travel path that can facilitate maintenance and in which travel wheels can travel directly by lining up a plurality of travel path forming units.

REFERENCE SIGNS LIST

1 Track
2 Road bed
3 Ballast
4 Travel face
5, 300 Travel path
50, 31 Travel path forming unit
511, 311 First plate
512, 312 Second plate
51*a*, 31*a* Unit travel face
51*b* Inclined face
52, 32 Positioning unit
521, 521*a* Convex portion
522, 522*a* Concave portion
53, 33 Guide post
54 Support member
55, 550 Connection member
60 First travel path forming unit
61 . . . (1A)-th plate
61*a* . . . (1A)-th formation face
61*b* . . . (1*a*1)-th inclined face
61*c* . . . (1*a*2)-th inclined face
62 . . . (2A)-th plate
62*a* . . . (2A)-th formation face
62*b* . . . (2*a*1)-th inclined face
62*c* . . . (2*a*)-th inclined face
70, 700 Second travel path forming unit
71, 710 . . . (1B)-th plate
71*a*, 710*a* . . . (1B)-th formation face
71*b*, 710*b* . . . (1*b*1)-th inclined face
71*c*, 710*c* . . . (1*b*2)-th inclined face
72, 720 . . . (2B)-th plate
72*a*, 720*a* . . . (2B)-th formation face
72*b*, 720*b* . . . (2*b*1)-th inclined face
72*c*, 720*c* . . . (2*b*2)-th inclined face
8 Guide rail
100 Vehicle
110 Vehicle body
120 Travel wheel
130 Guide device
131 Guide frame
132 Guide wheel
Dr Travel direction
Dw Width direction
Dv Vertical direction
S10 Arrangement step
S11 First arrangement step
S12 Second arrangement step
S20 Position adjusting step
S21 Guide rail fixing step
S22 Travel path forming unit lifting step
91 Jack-up member
S30 Travel path forming unit fixing step
92 Fixing jig
41 Crosstie
42 Rail
311*a* Plate body
311*b* Plate fixing portion
32*a* Positioning body
32*b* Positioning body fixing portion
80 Adjustment plate

The invention claimed is:

1. A track comprising a travel path including a travel face with which travel wheels of a vehicle come into contact while rolling, wherein the travel path includes:

a plurality of travel path forming units that are arranged to be adjacent to each other in a travel direction of the vehicle and of which each includes a unit travel face forming part of the travel face;

a positioning unit that fixes a relative position between the travel path forming units adjacent to each other; and guide posts to which a guide rail that guides the vehicle is attached, wherein each guide post is fixed to the corresponding travel path forming unit and extends in a direction crossing the unit travel face, and wherein the travel path further includes support members of which each protrudes outward in the width direction from an end face of the corresponding travel path forming unit crossing the corresponding unit travel face and facing the width direction of the vehicle and to which the corresponding guide posts are fixed.

2. The track according to claim 1, wherein each travel path forming unit includes an inclined face that is formed to be inclined with respect to the travel direction at an end face opposite to an end face of the other adjacent travel path forming unit.

3. The track according to claim 2, wherein each travel path forming unit includes, as the inclined face, a first inclined face that faces one side in the travel direction and a second inclined face that is inclined in a direction other than that of the first inclined face with respect to the travel direction and faces the other side in the travel direction.

4. The track according to claim 3, wherein the travel path includes a first travel path forming unit and a second travel path forming unit which are alternately arranged in the travel direction as the travel path forming units, and wherein the first inclined face of the first travel path forming unit and the first inclined face of the second travel path forming unit are inclined in different directions with respect to the travel direction.

5. The track according to claim 4, wherein a length in the travel direction of the second travel path forming unit is larger than a length in the travel direction of the first travel path forming unit.

6. The track according to claim 1, wherein each travel path forming unit includes:

a first plate with which only the travel wheel on one side in a width direction of the vehicle comes in contact; and a second plate that is disposed separated from the first plate in the width direction and with which only the travel wheel on the other side in the width direction comes in contact.

7. The track according to claim 1, wherein the travel path forming units are arranged directly on ballast installed on a road bed.

8. The track according to claim 1, further comprising:

a crosstie that is embedded in ballast; and a plurality of rails that are installed on the crosstie and are arranged separated from each other in the width direction of the vehicle, wherein the travel path forming units are arranged such that the unit travel faces are provided on the rails.

9. A travel path forming unit that forms a travel path including a travel face with which travel wheels of a vehicle come in contact while rolling by arranging a plurality of travel path forming units to be adjacent to each other in a travel direction of the vehicle, the travel path forming unit comprising:

a unit travel face that forms part of the travel face;

a guide post to which a guide rail that guides the vehicle is attached and that extends in a direction crossing the unit travel face; and a support member that protrudes outward in the width direction from an end face crossing the unit travel face and facing the width direction of the vehicle and to which the guide post is fixed.

10. The travel path forming unit according to claim 9, further comprising a positioning unit that fixes a position relative to the other adjacent travel path forming unit.

11. The travel path forming unit according to claim 9, further comprising an end face that crosses the unit travel face and opposes an end face of the other adjacent travel path forming unit, wherein the end face includes an inclined face that is formed to be inclined with respect to the travel direction.

12. The travel path forming unit according to claim 11, further comprising, as the inclined face, a first inclined face that faces one side in the travel direction and a second inclined face that is inclined in a direction other than that of the first inclined face with respect to the travel direction and faces the other side in the travel direction.

13. The travel path forming unit according to claim 9, further comprising:

a first plate with which only the travel wheel on one side in a width direction of the vehicle comes in contact; and a second plate that is disposed separated from the first plate in the width direction and with which only the travel wheel on the other side in the width direction comes in contact.

14. A method of laying a track including a travel path that includes a travel face with which travel wheels of a vehicle come in contact while rolling, the method comprising:

an arrangement step of arranging a plurality of travel path forming units, each of which includes a unit travel face forming part of the travel face, in a travel direction of the vehicle;

a position adjusting step of connecting the travel path forming units adjacent to each other using a positioning unit that fixes a relative position between the travel path forming units adjacent to each other and adjusting slopes of the plurality of unit travel faces with respect to a road bed together; and a travel path forming unit fixing step of fixing positions of the travel path forming units relative to the road bed, wherein the arrangement step includes arranging the travel path forming units of which each includes a guide post to which a guide rail guiding the vehicle is attached and that extends in a direction crossing the unit travel face, and wherein the position adjusting step includes a guide rail fixing step of fixing the guide rail to the plurality of guide posts.

15. The method of laying a track according to claim 14, wherein the arrangement step includes arranging each travel path forming unit including an inclined face that is formed to be inclined with respect to the travel direction at an end face opposite to an end face of the other adjacent travel path forming unit.

16. The method of laying a track according to claim 14, wherein the arrangement step includes:

a first arrangement step of arranging a plurality of first travel path forming units, each of which includes a first inclined face that faces one side in the travel direction and a second inclined face that is inclined in a direction other than that of the first inclined face with respect to the travel direction and faces the other side in the travel direction, at intervals in the travel direction; and a second arrangement step of arranging a plurality of second travel path forming units, each of which includes a first inclined face that is inclined in a direction other than that of the first inclined face of the first travel path forming unit with respect to the travel direction and that faces one side in the travel direction, between two of the first travel path forming units adjacent to each other in the travel direction.

17. The method of laying a track according to claim 14, wherein the position adjusting step includes a travel path forming unit lifting step of lifting the travel path forming units from the road bed, and wherein the travel path forming unit fixing step includes loading ballast between the lifted travel path forming units and the road bed and fixing positions of the travel path forming units relative to the road bed.

18. The method of laying a track according claim 14, wherein the arrangement step includes arranging the travel path forming units on a plurality of rails that are installed on a crosstie embedded in ballast and that are arranged to be separated from each other in the width direction of the vehicle.

* * * * *